US007765741B2

(12) United States Patent
Miller et al.

(10) Patent No.: US 7,765,741 B2
(45) Date of Patent: Aug. 3, 2010

(54) MOVABLE LIGHT LATCH

(75) Inventors: Gary L. Miller, Pella, IA (US); Kenneth E. Nossaman, Pella, IA (US); Marlo G. Van Klompenburg, Pella, IA (US); Scot C. Miller, Pella, IA (US)

(73) Assignee: Pella Corporation, Pella, IA (US)

( * ) Notice: Subject to any disclaimer, the term of this patent is extended or adjusted under 35 U.S.C. 154(b) by 1272 days.

(21) Appl. No.: 11/297,576

(22) Filed: Dec. 8, 2005

(65) Prior Publication Data

US 2006/0150514 A1 Jul. 13, 2006

Related U.S. Application Data

(60) Provisional application No. 60/642,811, filed on Jan. 11, 2005.

(51) Int. Cl.
*E05C 19/00* (2006.01)

(52) U.S. Cl. ..... 49/394; 49/395; 49/379; 49/67

(58) Field of Classification Search ..... 49/394, 49/395, 379, 61, 62, 63, 65, 67; 292/137, 292/163, 164, 169, 175, DIG. 37, DIG. 20
See application file for complete search history.

(56) References Cited

U.S. PATENT DOCUMENTS 651,464 A * 6/1900 Lint ..... 292/254
2,108,965 A * 2/1938 Gray ..... 292/75
2,568,130 A * 9/1951 Olson ..... 49/62
3,382,611 A * 5/1968 Zandelin ..... 49/67
3,474,572 A * 10/1969 Rothemund ..... 49/390
4,059,298 A 11/1977 Van Klompenburg
4,095,829 A 6/1978 Van Klompenburg
4,126,965 A 11/1978 Hoffmann
4,160,348 A 7/1979 Chapman et al.
4,182,088 A 1/1980 Ball
4,223,481 A 9/1980 Page
4,369,828 A 1/1983 Tatro
4,429,910 A 2/1984 Anderson (Continued)

FOREIGN PATENT DOCUMENTS

DE 3720995 A1 1/1989

(Continued)

OTHER PUBLICATIONS

Internorm® company and product information, www.internorm.com, 5 pages.

*Primary Examiner*—Gregory J. Strimbu
(74) *Attorney, Agent, or Firm*—Faerge & Benson LLP

(57) ABSTRACT

A window or door assembly having a secondary sash hinged to a prime sash and movable between a closed position and an open position toward an interior region. The prime sash is coupled to a frame. A compressible member biases the secondary sash toward the open position. A latch assembly is provided including a plurality of retractable latching elements each biased to an extended position to retain the secondary sash in the closed position. The latch assembly includes a sliding operator accessible from the interior region and slidable along an edge of the secondary sash to sequentially displace the retractable latching elements to a retracted position sufficient for the compressible member to move the secondary sash toward the open position.

17 Claims, 27 Drawing Sheets

U.S. PATENT DOCUMENTS 4,641,466 A 2/1987 Raninen et al.
4,664,169 A 5/1987 Osaka et al.
4,676,024 A 6/1987 Rossman
4,687,040 A 8/1987 Ball
4,733,510 A 3/1988 Werner
4,799,330 A * 1/1989 Hudson ..... 49/62
4,913,213 A 4/1990 Schnelker
4,934,438 A 6/1990 Yuhas et al.
5,000,242 A 3/1991 Coddens
5,083,398 A * 1/1992 Kolbeck et al. ..... 49/395
5,086,604 A 2/1992 Orth
5,226,466 A 7/1993 Coddens
5,253,457 A 10/1993 Orth
5,282,504 A 2/1994 Anderson et al.
5,299,399 A 4/1994 Baier et al.
5,325,579 A 7/1994 Baier
5,379,825 A 1/1995 Jelic
5,390,454 A 2/1995 Coddens
5,430,982 A 7/1995 Bane
5,566,507 A 10/1996 Schmidt et al.
5,611,381 A 3/1997 Jelic
5,649,389 A 7/1997 Coddens
5,826,638 A 10/1998 Jelic
5,927,768 A * 7/1999 Dallmann et al. ..... 292/158
5,934,351 A 8/1999 Bharucha et al.
6,006,813 A 12/1999 Jelic
6,009,931 A 1/2000 Peterson
6,070,638 A 6/2000 Jelic
6,173,754 B1 1/2001 DeBlock
6,186,306 B1 * 2/2001 Kamm ..... 193/31 A
6,421,960 B1 * 7/2002 Manzella ..... 49/192
6,557,475 B1 * 5/2003 Nygren et al. ..... 102/377
6,640,389 B2 11/2003 Van Klompenburg et al.
6,736,185 B2 5/2004 Smith et al.
7,021,360 B2 4/2006 Schroder et al.
2003/0015300 A1 1/2003 Colson et al.
2006/0086051 A1 * 4/2006 Woods et al. ..... 49/394

FOREIGN PATENT DOCUMENTS

EP 0041875 A1 12/1981
EP 0119361 B1 9/1984

* cited by examiner

MOVABLE LIGHT LATCH

CROSS REFERENCES

The present application claims the benefit of commonly assigned provisional U.S. Patent application 60/642,811, entitled MOVABLE LIGHT LATCH, filed on Jan. 11, 2005 which is hereby incorporated herein by reference.

U.S. provisional patent application Nos. 60/654,813, entitled WINDOW COVERING DRIVE SYSTEM, filed on Jan. 11, 2005; 60/642,812, entitled WINDOW COVERING LEVELING MECHANISM AND METHOD, filed on Jan. 11, 2005; and 60/643,064, entitled WINDOW ASSEMBLY WITH MOVABLE INTERIOR SASH, filed on Jan. 11, 2005, are hereby incorporated herein by reference.

FIELD OF INVENTION

The present invention relates to a window assembly, and more particularly to a latching assembly for a window assembly with a prime sash and a secondary movable sash attached to the prime sash.

BACKGROUND OF THE INVENTION

Prior to the concern over energy efficiency and cost savings in building maintenance, many buildings, both residential and commercial, were constructed with a window assembly having a primary-glazing pane. In order to decrease thermal losses through window openings and increase the desirability and livability of these older buildings, either interior or exterior storm windows that create a multiple pane window unit are used.

Exterior storm windows are typically mounted on the exterior of the building to cover the primary glazing and shield it from the environment. Such arrangements have served to provide improved insulation, but are also subject to certain drawbacks.

The exterior storm windows are usually constructed of rigid, weather resistant materials, such as aluminum or other metals. These materials have relatively high thermal conductivity and, as a result, conduct heat away from the interior of the building and therefore do not permit maximum energy efficiency. In addition, the exterior storm windows can be difficult to install and can require expensive, professional installation due to things such as ground landscaping or the height at which the windows would have to be installed. In some commercial buildings the window elevations are so extreme that exterior storm windows are not available at all as a practical matter. With certain historic buildings and condominium dwellings, use of exterior storm windows is prohibited by law or restrictive covenant. Even when such storm windows can be easily installed, to apply them over casement or awning windows typically restricts or entirely eliminates the workability of those window assemblies.

U.S. Pat. Nos. 4,160,348 (Chapman et al.); 4,369,828 (Tatro); and 5,282,504 (Anderson et al.) disclose interior storm windows attached to the window frame at the interior of the building. Such storm windows have, for example, been held in place by magnetic strips or guide tracks secured to the window frame adjacent to the primary glazing pane. The interior storm windows can be employed at all building elevations and are substantially unnoticeable from the building exterior, thus overcoming many of the limitations on usage of the exterior storm windows. Further, because these storm windows are on the inside of the building, they do not need to be as weather resistant. Therefore, the interior storm windows can be constructed of materials that are less thermally conductive.

However, interior storm windows typically require careful, on-site measurement of each window and largely custom construction often with professional assistance. A finish trim often needs to be cut and stained at the site and installed separately from the storm window. Further, the interior storm windows often interfere with window hardware, such as handles and cranks for casement or awning windows. This hardware must be removed and the window assemblies rendered inoperative if the interior storm window is to be installed. Likewise, since interior storm windows are fixedly mounted to the window frame, the window's mounting frame and panes restrict access to the primary glazing pane for cleaning and/or removal of the primary glazing pane. Similarly, in window openings of lesser depth, use of the interior storm windows can preclude use of a Venetian blind or shade between the primary glazing pane and the storm window pane. Such between window mountings of blinds would otherwise be desirable to decrease the accumulation of dust on the blinds.

BRIEF SUMMARY OF THE INVENTION

The present invention is directed to a closure assembly having a frame and a prime sash coupled to the frame. A secondary sash is hinged to one of the prime sash and the frame and is movable between a closed position and an open position toward an interior region. A compressible member biases the interior sash toward the open position. A latch assembly is provided including a plurality of retractable latching elements each biased to an extended position to retain the interior sash in the closed position. The latch assembly includes a sliding operator accessible from the interior region and slidable along an edge of the interior sash to sequentially displace the retractable latching elements to a retracted position sufficient for the compressible member to move the interior sash toward the open position.

In one embodiment, the prime sash is coupled to the frame and movable between a closed position and an open position.

The retractable latching elements can be positioned on either of the prime sash or the interior sash. The sliding operator can be slidably coupled to either of the interior sash or the prime sash. In one embodiment, the sliding operator includes a first tapered portion positioned to engage the retractable latching element. The sliding operator preferably moves along a first axis generally perpendicular to an axis of displacement for the retractable latching element. In another embodiment, the sliding operator comprises a first tapered portion positioned to engage with the retractable latching element and a second tapered portion opposing the first tapered portion. The sliding operator preferably can move in either direction along a first axis and is adapted to sequentially displace the retractable latching elements to the retracted position in either direction.

In one embodiment, the latching element comprises a beveled surface positioned to engage with either of the prime sash or the interior sash and retract as the interior sash is moved from the open position to the closed position. The compressible member preferably comprises an elastomeric seal positioned between the interior sash and the prime sash.

The present invention is also directed to a latch assembly for a window assembly of the type having a secondary sash hinged to a prime sash, the secondary sash movable between a closed position and an open position toward an interior region. The window assembly includes a compressible member that biases the secondary sash toward the open position. The latch assembly comprises a plurality of retractable latching elements each biased to an extended position to retain the secondary sash in the closed position. A sliding operator is provided that is accessible from the interior region and slidable along an edge of the secondary sash to sequentially displace the retractable latching elements to a retracted position sufficient for the compressible member to move the secondary sash toward the open position.

The present invention is also directed to a method of operating a latch assembly for a closure. The method includes the steps of retaining a secondary sash hinged to a prime sash in a closed position to form a cavity between the secondary sash and a prime sash. The secondary sash is biased toward an open position away from the prime sash. A sliding operator accessible from an interior region of the closure is moved along an edge of the secondary sash to sequentially displace at least one retractable latching element to a retracted position sufficient for the secondary sash to be biased toward the open position. The present method also includes the steps of moving the secondary sash from the open position to a closed position. The latching elements are engaged with either of the secondary sash or the prime sash to retract the latching element as the secondary sash is moved from the open position to the closed position.

DETAILED DESCRIPTION OF THE INVENTION

The complete disclosures of commonly assigned U.S. Patent application 60/642,811, entitled MOVABLE LIGHT LATCH, filed on Jan. 11, 2005; 60/642,813, entitled WINDOW COVERING DRIVE SYSTEM, filed on Jan. 11, 2005; 60/642,812, entitled WINDOW COVERING LEVELING MECHANISM AND METHOD, filed on Jan. 11, 2005; and 60/643,064, entitled WINDOW ASSEMBLY WITH MOVABLE INTERIOR SASH, filed on Jan. 11, 2005, are incorporated by reference.

U.S. provisional patent application Nos. 60/642,813, entitled WINDOW COVERING DRIVE SYSTEM, filed on Jan. 11, 2005; 60/642,812, entitled WINDOW COVERING LEVELING MECHANISM AND METHOD, filed on Jan. 11, 2005; and 60/643,064, entitled WINDOW ASSEMBLY WITH MOVABLE INTERIOR SASH, filed on Jan. 11, 2005, are hereby incorporated herein by reference.

Figure 1:
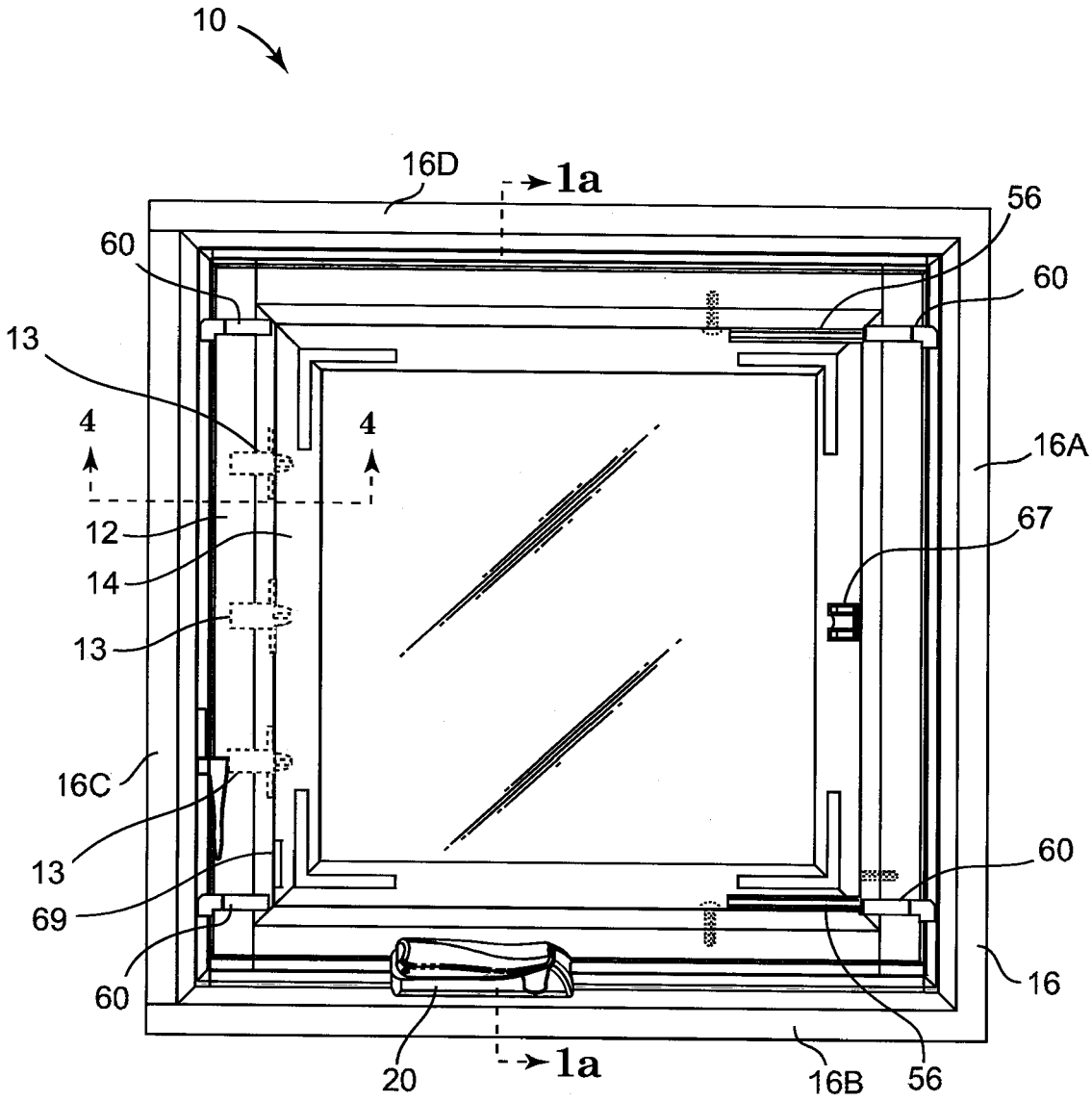
FIG. 1 is an inside elevation view of an embodiment of a window assembly with a prime sash having a secondary sash attached and in the closed position in accordance with one embodiment of the present invention.
Figure 1A:
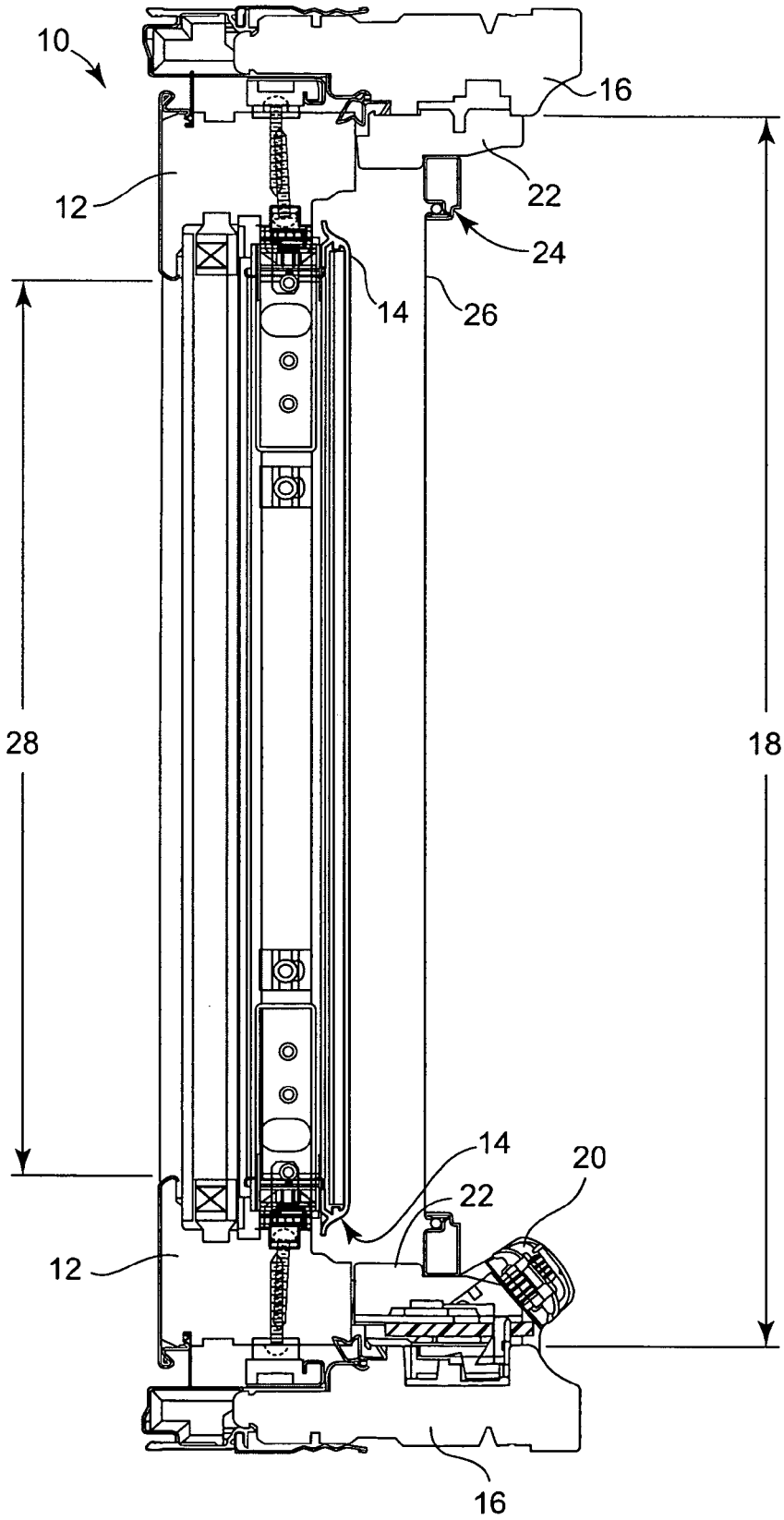
FIG. 1*a* is a cross-sectional view of the window assembly of FIG. 1 taken along line 1*a*-1*a*.

Referring now to FIGS. 1 and 1*a*, an embodiment of a closure assembly 10 in accordance with the present invention can be seen as it would be viewed from inside a structure in which it is installed. The closure assembly 10 includes a window frame 16 adapted to be received in a rough opening created in a building structure (not shown). As used herein the phrase "window frame" refers to a framework mounted in a rough opening of a building structure for receiving and supporting one or more sashes of a window assembly. As used herein, the term "sash" refers to a framework for receiving and supporting one or more glazing panes. In double hung, awning, and casement windows, the sashes can be moved relative to the window frame. In a fixed window, the sash does not typically move relative to the window frame, but can be removed for repair purposes. Similar window assemblies may also be included in door assemblies. In a door, there can be a fixed or a moveable sash or multiple combinations of both. The moveable door sash can be moved laterally (sliding or rolling) or pivoting with side hinges. As used herein, the phrase "closure" refers to both a window and a door, although closure assembly 10 generally takes the form of a window.

The window frame 16 can be constructed of wood, vinyl, aluminum, or a variety of other materials. In the illustrated embodiment, the window frame 16 includes four peripheral frame members, 16A, 16B, 16C, and 16D, joined and secured together to form a rectangular shape corresponding to the shape of the rough opening. The inner perimeter of the rough opening is slightly larger than the perimeter of the window frame 16 of the closure assembly 10, so that the closure assembly 10 can be received in the rough opening during installation. The methods of mounting the window frame 16 to the rough opening are well known in the window industry. The window frame 16 defines a window opening 18. In the illustrated embodiment, the window opening 18 has a rectangular shape. Although the closure assembly 10 in the illustrated embodiment is rectangular, it is understood that the present invention is not limited by the shape of the closure assembly 10 as illustrated.

The closure assembly 10 also includes a prime sash 12 attached to the window frame 16 and received in the window opening 18 defined by the window frame 16. In the illustrated embodiment, the prime sash 12 is operated in the same or a similar manner as a conventional casement window. In other words, a vertical edge of the prime sash 12 is hinged to a jamb of the window frame 16 allowing the opposite vertical edge of the prime sash 12 to swing outwardly from the window frame 16. In another embodiment, the prime sash 12 can be fixedly mounted to and received in the window frame 16. In yet another embodiment, the prime sash 12 can be fixedly mounted to and received in the rough opening of the building structure (not shown).

The prime sash 12 may be made of durable material, such as wood, vinyl, aluminum or variety of other materials. The methods of making window sashes are well known in the window manufacturing industry.

A sash operator 20 for opening and closing the prime sash 12 uses a crank to actuate a linkage for pulling the prime sash 12 open and pushing it shut. The closure assembly 10 may include a decorative wood trim 22 mounted to the window frame 16 along the inner perimeter of the window frame 16. Further, a retractable screen 26 can optionally be included in the window closure 10. In the illustrated embodiment, a mechanism 24 for operating the retractable screen 26 can be attached to the wood trim 22.

Figure 2:
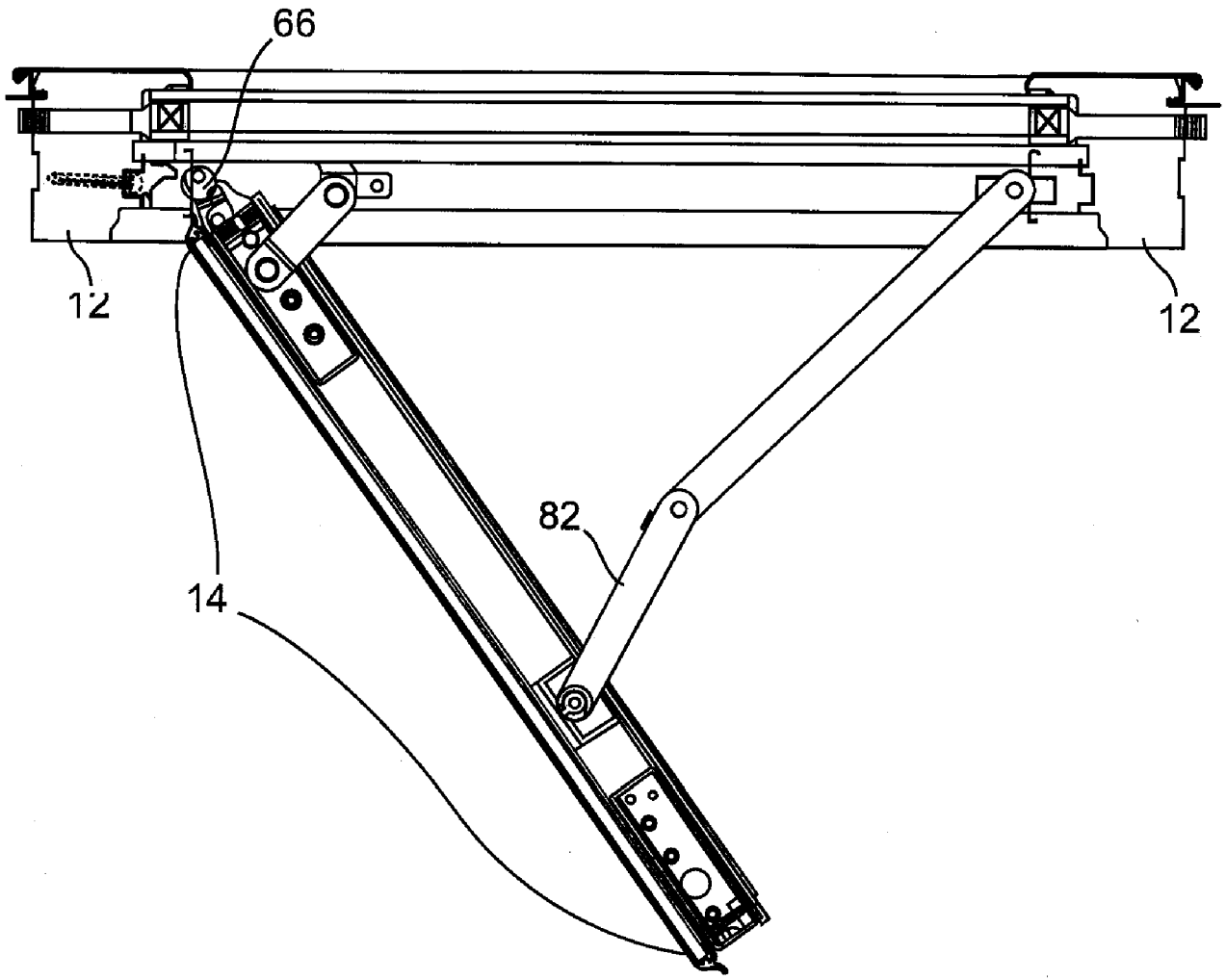
FIG. 2 is a top view of the prime and secondary sashes of the window assembly of FIG. 1 with the secondary sash in an open position.
Figure 3:
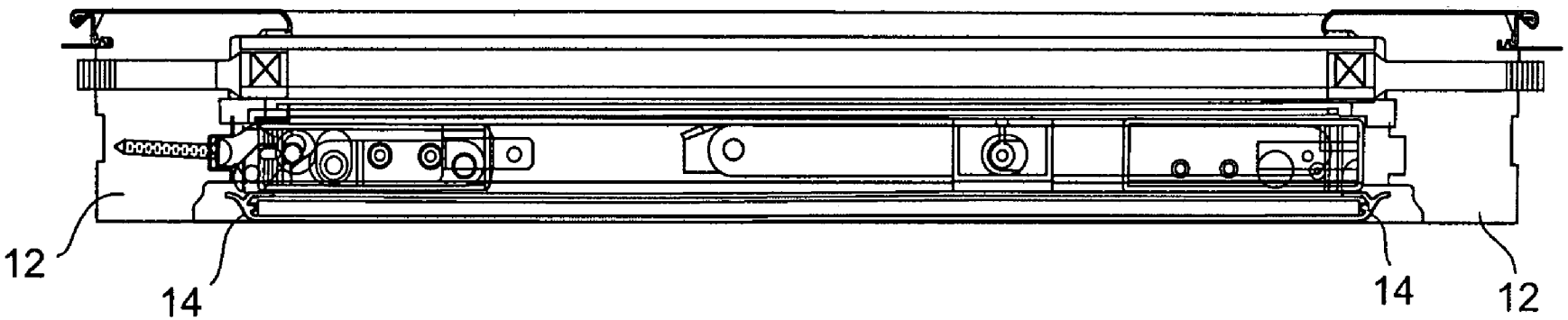
FIG. 3 is a top view of the prime and secondary sashes of the window assembly of FIG. 1 with the secondary sash in a closed position.

Referring to FIGS. 2 and 3, the closure assembly 10 further includes an openable secondary sash 14 that is pivotally attached to the prime sash 12. Secondary sash 14 is generally attached interiorly relative to prime sash 12. Thus, prime sash 12 can be referred to as a prime sash and secondary sash 14 can be referred to as a secondary sash. FIG. 2 shows the secondary sash 14 in an open position, while FIG. 3 shows that the secondary sash 14 is in a closed position. In the illustrated embodiment, the secondary sash 14 is pivotally attached to the prime sash 12 by one or more hinge members 66. In another embodiment, the secondary sash 14 can be removably attached to the prime sash 12. Although the present embodiment is to a casement window, all discussions herein of the secondary sash 14 apply equally to double hung, awning, fixed windows, and doors.

Referring now to FIG. 1, a one or more latch mechanisms 13 (shown in broken lines) for locking the secondary sash 14 to the prime sash 12 is included in the closure assembly 10, also described as a window assembly 10, and will be discussed in greater detail later on. However, other suitable lock mechanisms are well known in the art as is shown in U.S. Pat. Nos. 4,059,298; 4,095,829; and/or 4,429,910, which are hereby incorporated by reference. Latch mechanism 13 is positioned on the left side of the closure assembly 10, implying that the secondary sash 14 is hinged to the prime sash 12 on the right side. In other embodiments the secondary sash 14 is hinged elsewhere, and the latch mechanism 13 is positioned on an opposite side thereof.

Figure 4:
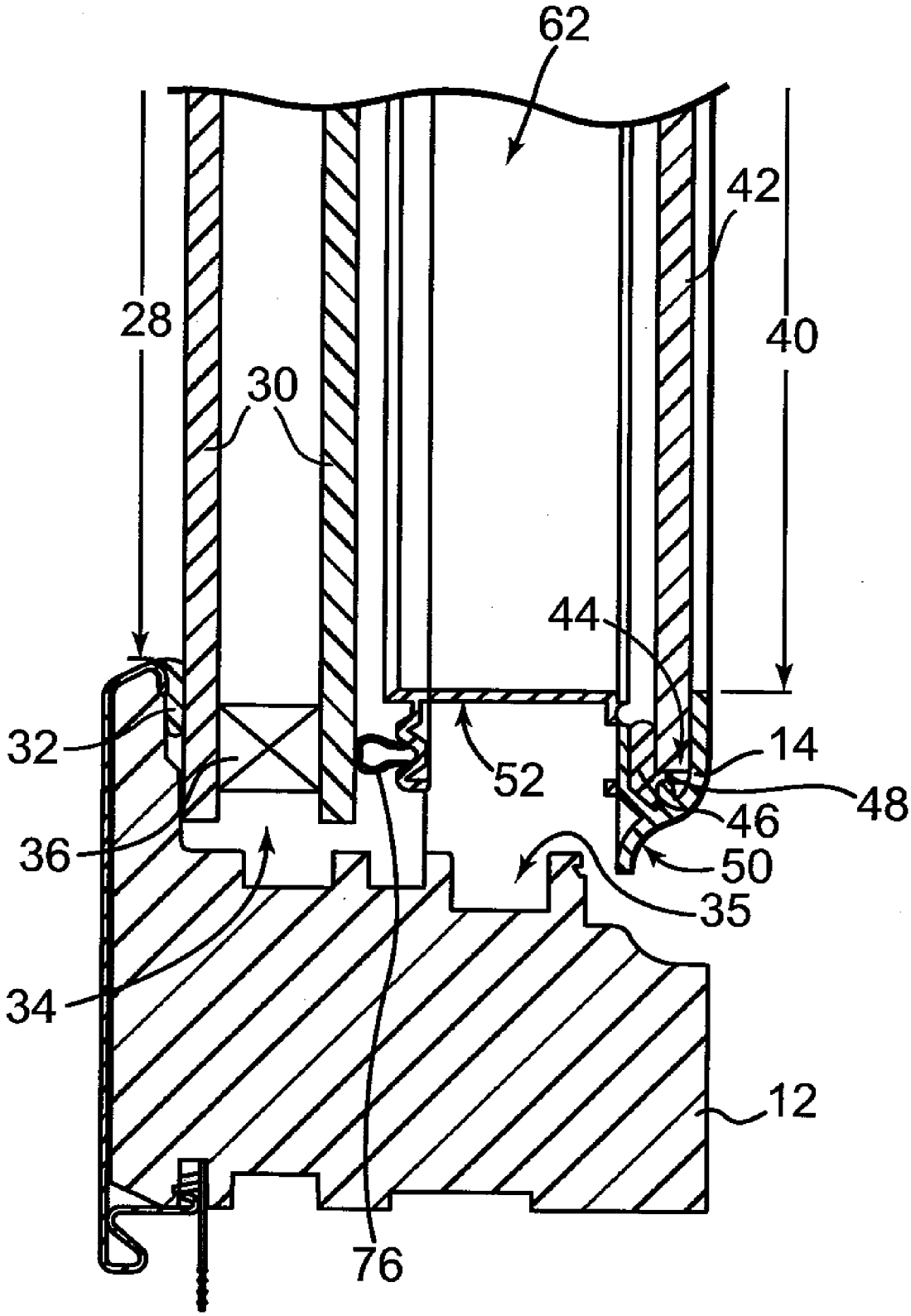
FIG. 4 is a cross-sectional view of the prime and secondary sashes of FIG. 1 taken along line 4-4 with the corner lock removed.

FIG. 4 is a cross-sectional view of the prime and secondary sashes 12 and 14 of FIG. 1 taken along line 4-4. The prime sash 12 defines a first or prime glazing opening 28. In the illustrated embodiment, a pair of prime glazing panes 30 are received in a retention groove 34 formed in the prime sash 12 to cover the prime glazing opening 28. The groove 34 extends along the inner perimeter of the prime sash 12. Glazing material 32 (e.g., silicone) can be applied around the perimeter of the prime glazing panes 30 to hold the prime glazing panes 30 into the groove 34 of prime sash 12. A spacer 36 can be positioned between prime glazing panes 30 and can extend around the perimeter of the prime glazing panes 30.

Figure 5:
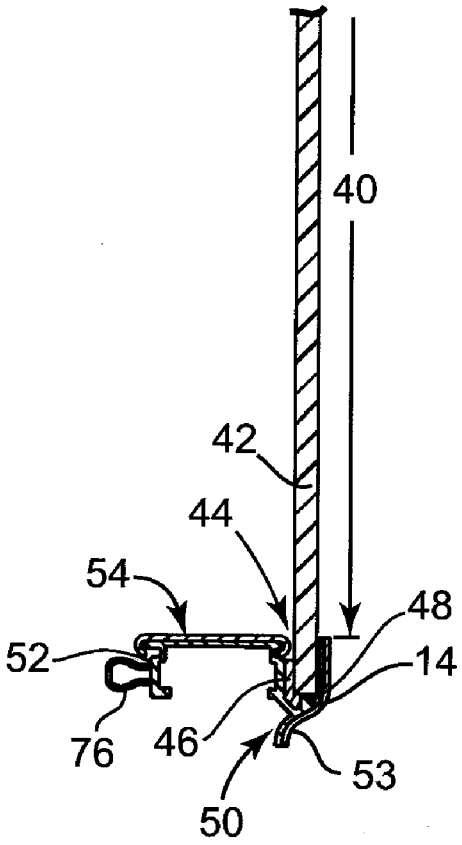
FIG. 5 is a fragmentary side sectional view of the secondary sash of FIG. 2.
Figure 6:
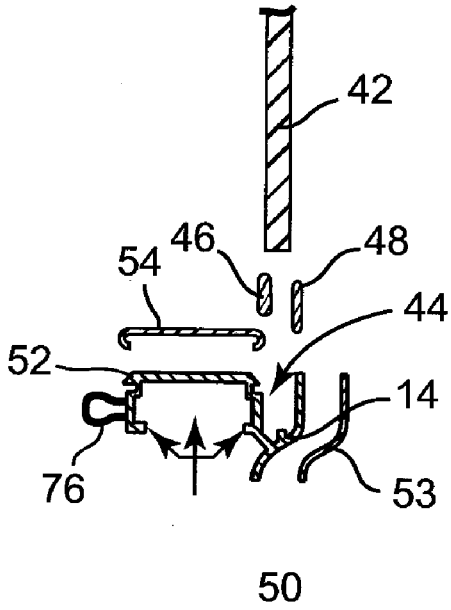
FIG. 6 is a fragmentary exploded side sectional view of the secondary sash of FIG. 2.

Referring to FIGS. 4, 5, and 6, the secondary sash 14 includes a periphery portion 50 and an interior portion 52. In the illustrated embodiment, the periphery portion 50 and the interior portion 52 extend along the perimeter of the secondary sash 14. When the secondary sash 14 is in the closed position, the interior portion 52 extends toward the prime glazing panes 30. A gasket 76 can be included with the secondary sash 14 to seal the secondary sash 14 to the prime sash 12. The gasket 76 generally extends along the inner perimeter of the secondary sash 14. The gasket 76 can be made of foam or plastic material.

The secondary sash 14 defines a second or secondary glazing opening 40. In the illustrated embodiment, a secondary glazing pane 42 is received in a retention groove 44 formed in the secondary sash 14 to cover the secondary glazing opening 40. The retention groove 44 extends along the inner perimeter of the secondary sash 14. Glazing materials 46 (e.g., butyl mastic) and 48 (e.g., urethane adhesive) can be applied around the perimeter of the secondary glazing pane 42 to hold the secondary glazing pane 42 into the retention groove 44 of the secondary sash 14.

The secondary sash 14 may be made of vinyl or aluminum through extrusion processes, which are commonly known in the window manufacturing industry. Referring to FIGS. 5 and 6, a first decorative cover 53 can be glued to the periphery portion 50 of the secondary sash 14 along the perimeter of the periphery portion 50. A second decorative cover 54 can be snapped onto the interior portion 52 of the secondary sash 14 along the perimeter of the interior portion 52. The first and second decorative covers 53 and 54 can be painted aluminum or colored plastic. In another embodiment, the first decorative cover 53 can be snapped onto the periphery portion 50, while the second decorative cover 54 can be glued to the interior portion 52.

Referring particularly to FIG. 4, the prime glazing panes 30 are generally positioned in the exterior of the building structure (not shown), while the secondary glazing pane 42 is generally positioned in the interior of the building structure (not shown). The prime glazing panes 30 and the secondary-glazing pane 42 define a substantially closed air chamber 62.

The prime sash 12 includes a channel 35 formed in at least a portion of the prime sash 12 along the inner perimeter of the prime sash 12. The channel 35 generally faces the air chamber 62. The channel 35 can be used for receiving one or more window accessory operating mechanisms. The details of the operating mechanisms will be discussed below. In the illustrated embodiment, the channel 35 has generally a "U" shape. In another embodiment, the channel 35 can be an "L" shape. The interior portion 52 covers at least a portion of the channel 35 when the secondary sash 14 is in the closed position. In the illustrated embodiment, the periphery portion 50 and the interior portion 52 substantially cover the channel 35 when the secondary sash 14 is in the closed position, so that a window accessory operating mechanism can be hidden in the channel 35.

Figure 7:
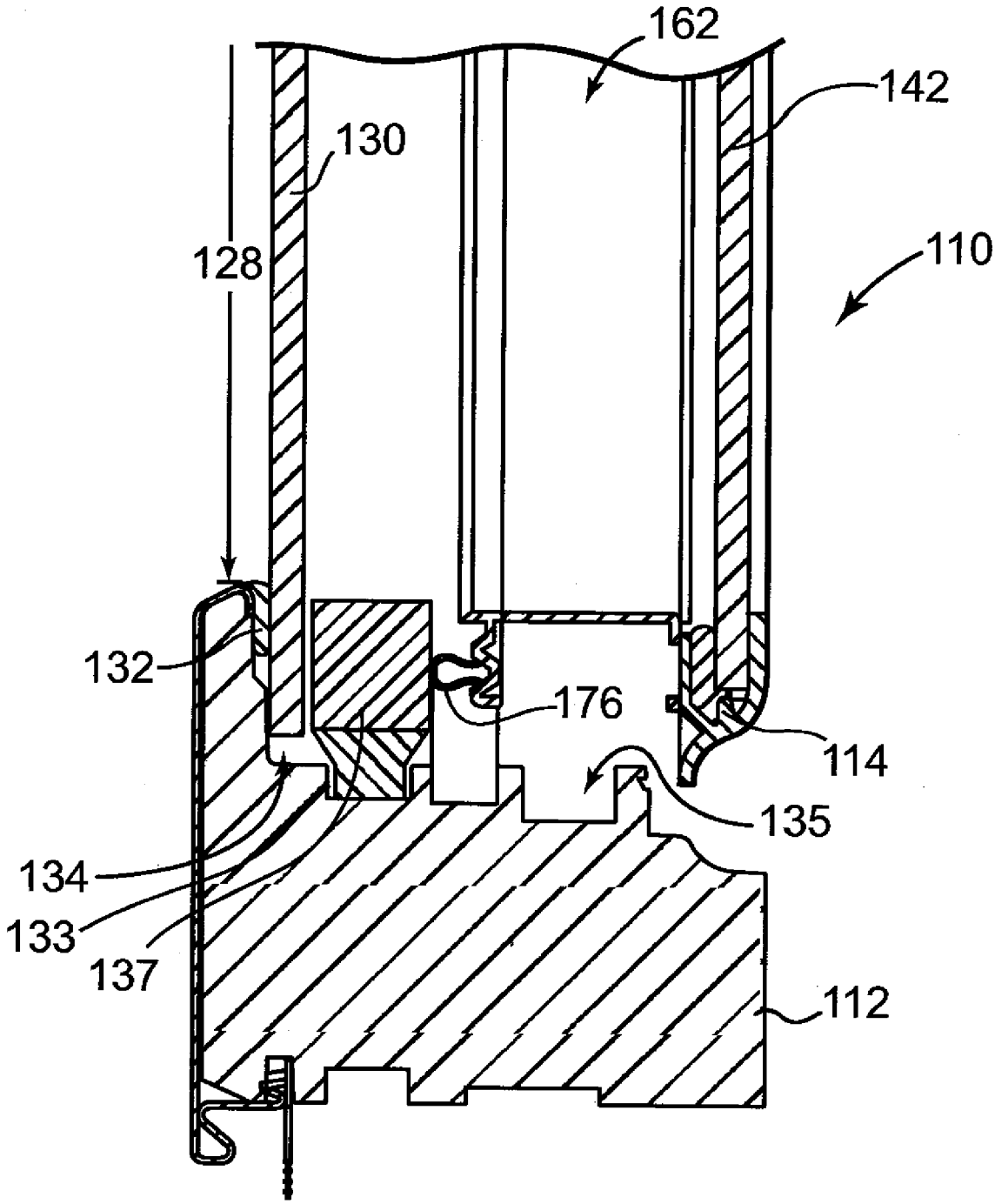
FIG. 7 is an alternate embodiment of a prime and a secondary sash with the secondary sash in a closed position in accordance with the present invention.

Referring now to FIG. 7, another embodiment of a closure assembly 110 with prime and secondary sashes 112 and 114 can be seen. The embodiment of FIG. 7 is somewhat similar to the afore-mentioned embodiments, and like parts are given like numbering. In this embodiment, only one prime glazing pane 130 is received in a retention groove 134 formed in the prime sash 112 to cover a prime glazing opening 128. The retention groove 134 extends along the inner perimeter of the prime sash 112. Glazing material 132 (e.g., silicone) is then applied around the perimeter of the prime glazing pane 130 to hold the prime glazing pane 130 into the retention groove 134 of the prime sash 112. A spacer 137 is fixed into a groove 133 between the prime glazing pane 130 and a gasket 176 on the secondary sash 114. The spacer 137 may extend along the inner perimeter of the prime sash 112. The spacer 137 provides a sealing surface for the gasket 176 of the secondary sash 114 when the secondary sash 114 is in a closed position. The spacer 137 is an aluminum strip that is either flat or formed into a profile. The aluminum strip is encased in a plastic material such as PVC, and serves as a stabilizer to prevent the spacer 137 from shortening due to hot/cold cycles. Retention barbs (not visible) are included to retain the spacer 137 in the groove 133 in the prime sash 12. The secondary sash 114 is included in the window assembly 110 in the same or a similar manner as described for the secondary sash 14 shown in FIG. 4. A secondary glazing pane 142 is received in the secondary sash 114. The prime sash 112 includes a channel 135 formed in at least a portion of the prime sash 112 along the inner perimeter of the prime sash 112. The channel 135 generally faces the air chamber 162 between the prime glazing pane 130 and the secondary glazing pane 142. The channel 135 can be used for receiving one or more window accessory operating mechanisms.

Figure 8:
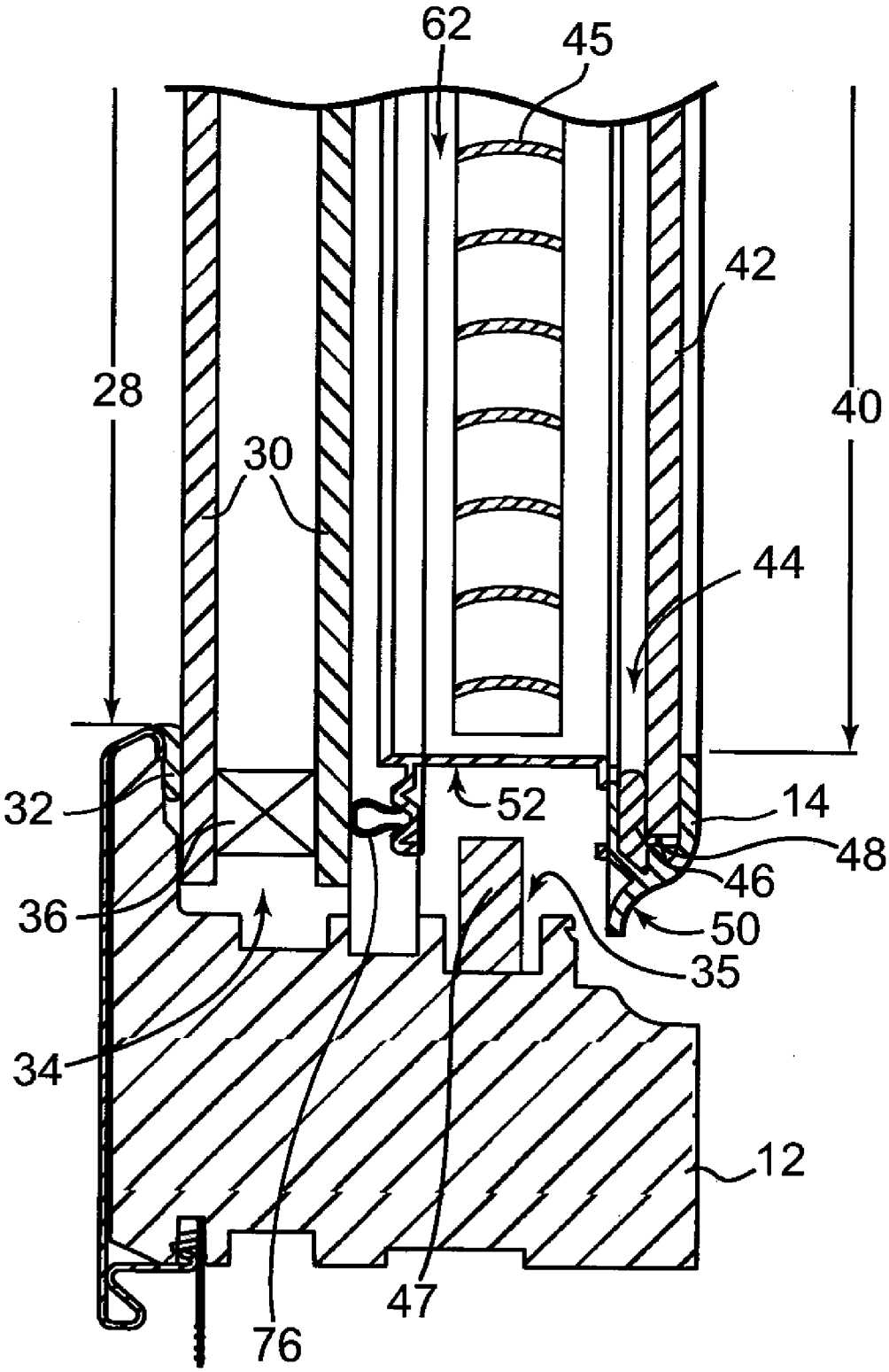
FIG. 8 is a cross-sectional view of the window assembly of FIG. 1 taken along line 4-4 with a window accessory in accordance with one embodiment of the present invention.

Referring to FIG. 8, one or more window accessories (e.g., a grid, a grille, a shade, a screen, a blind, and a window fashion) can be placed in the air chamber 62 between the prime glazing panes 30 and the secondary glazing pane 42. In the illustrated embodiment, a blind 45 is placed in the air chamber 62. One or more accessory operating assemblies 47 for operating the window accessories (e.g. the blind 45) can be placed in the channel 35 of the prime sash 12 and covered by the periphery portion 50 and the interior portion 52 of the secondary sash 14. Suitable accessory operating mechanisms can be found in U.S. Pat. Nos. 6,736,185, 5,934,351, 4,934,438, 4,913,213, and U.S. patent application Ser. No. 10,437,773, all of which are incorporated herein by reference.

Figure 9:
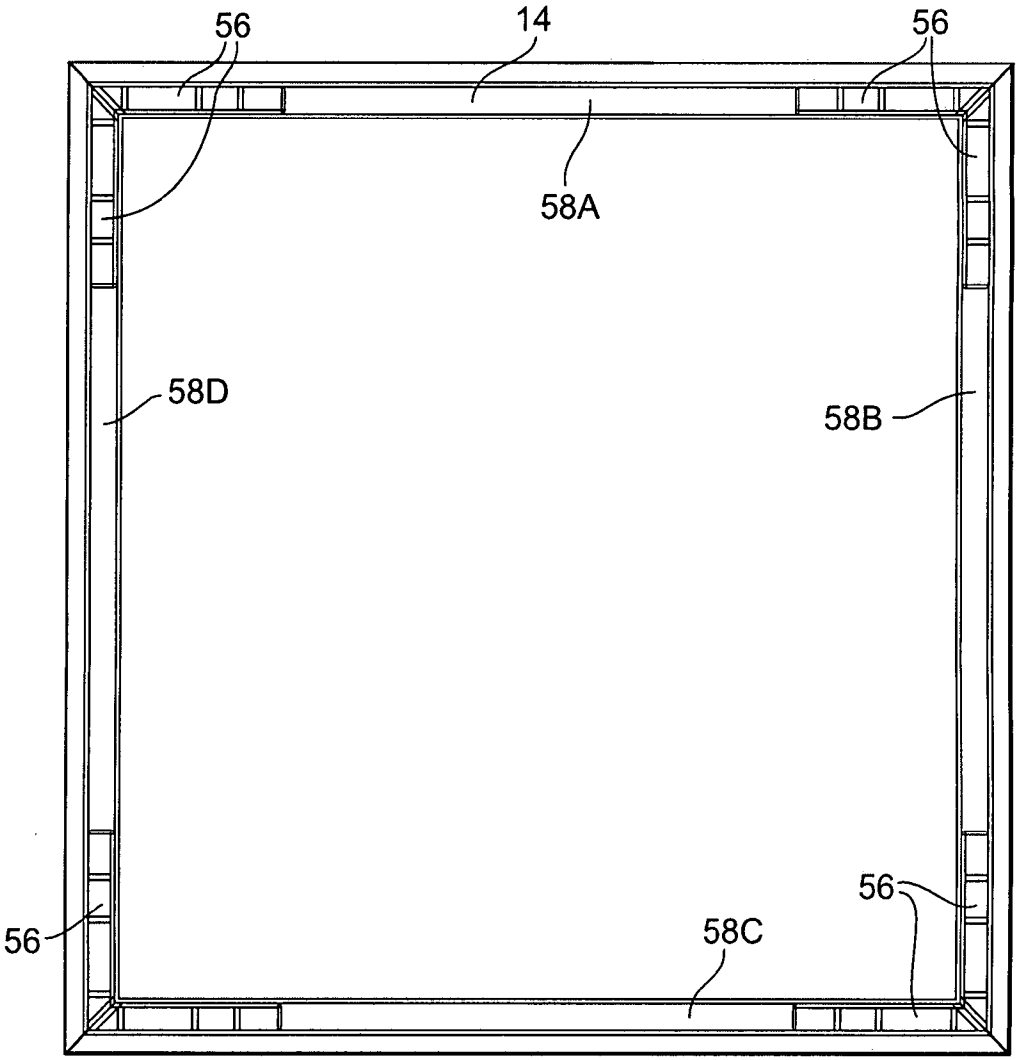
FIG. 9 is a front view of the secondary sash of FIG. 2.
Figure 10:
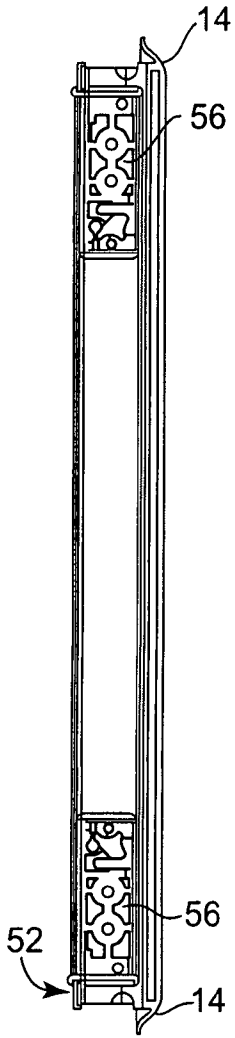
FIG. 10 is a side view of the secondary sash of FIG. 2.

Referring to FIGS. 9 and 10, the secondary sash 14 of the closure assembly 10 can be seen. In the illustrated embodiment, the secondary sash 14 is made of sash members including a head member 58A, a first stile 58B, a sill member 58C and a second stile 58D. The closure assembly 10 may include corner locks 56, which are corner fasteners for use in joining and securing the sash members 58 together. Corner locks are well known in the window and door construction industry. Typically, each of the sash members 58A-D has a 45° miter. When the sash members 58A-D are brought together, they form a 90° corner. The corner lock 56 functions to both secure the two sash members 58 together and to properly align the sash members 58, so that the two sash members 58 are properly aligned along their 45° miters so as to form a true 90° angle when secured to each other. The joint angles do not necessarily have to be 90°. The joint angles could be 105°, 70°, 150°, etc. with corresponding miter angles of one-half of the joint angle. The secondary sash 14 does not necessarily have to be rectangular and does not necessarily have to be made of four sash members 58. The shape of the secondary sash 14 generally corresponds to the shape of the prime sash 12.

Figure 11:
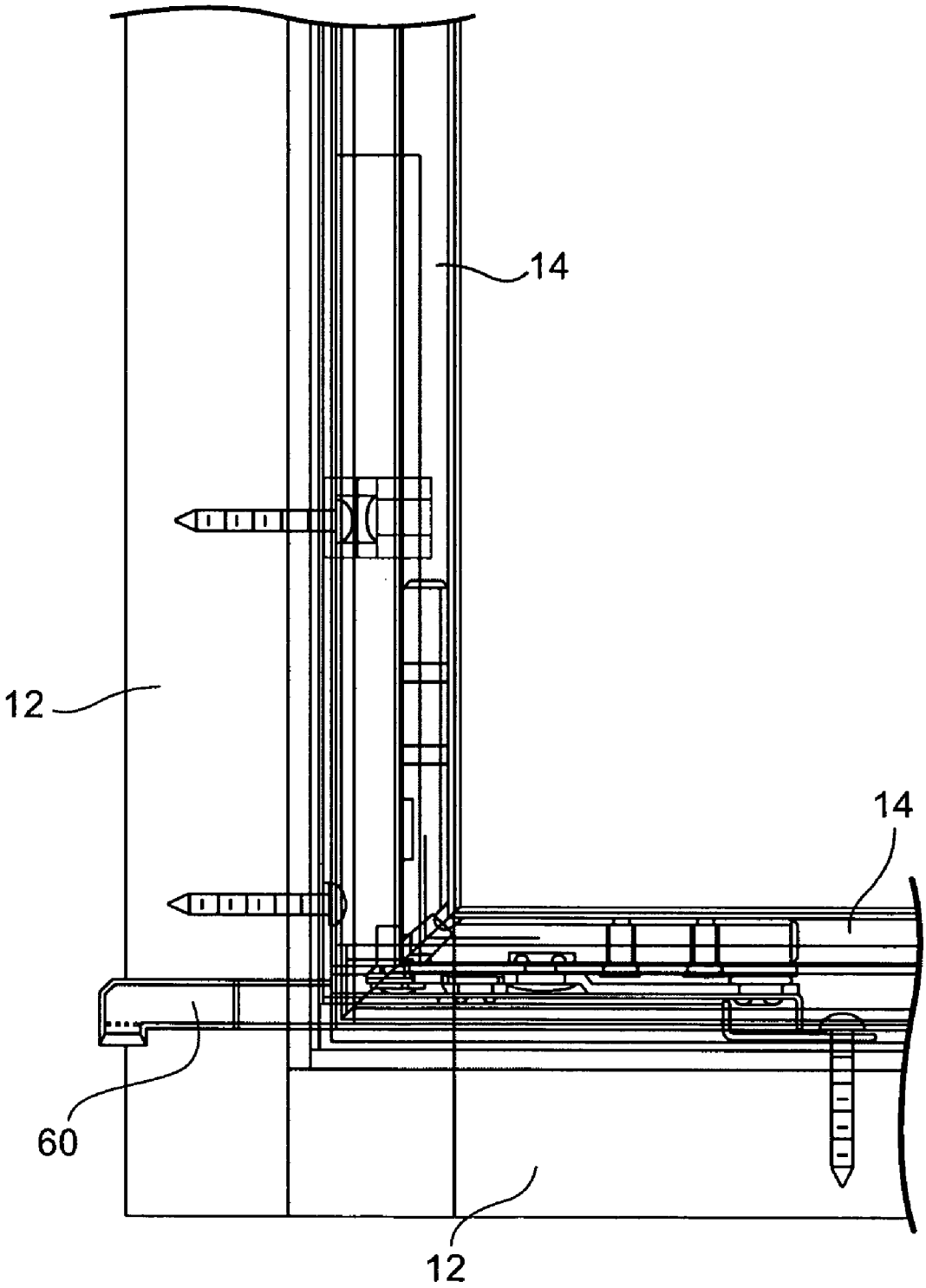
FIG. 11 is a fragmentary front sectional view of the window assembly of FIG. 2 with the secondary sash in the closed position.
Figure 12:
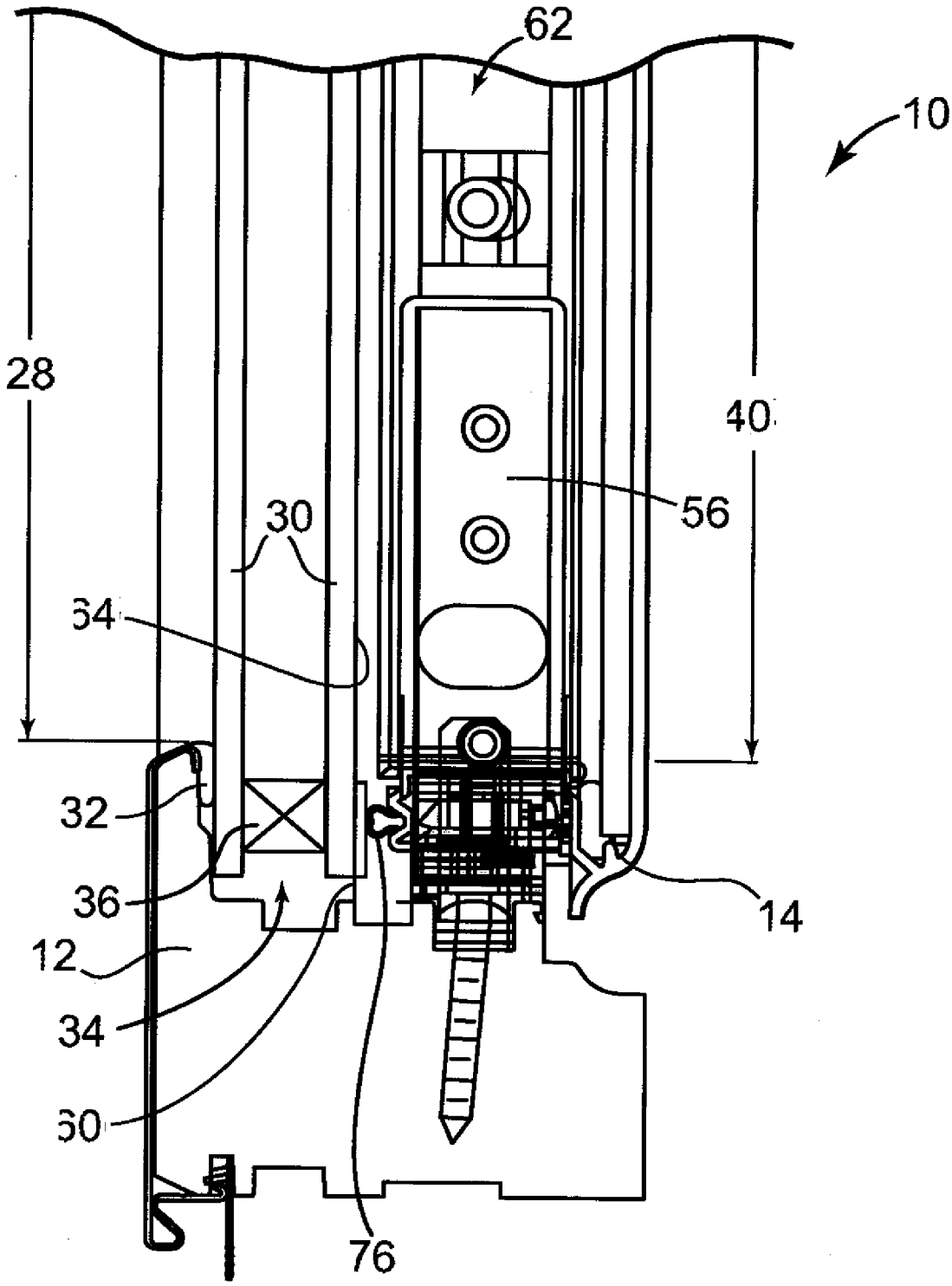
FIG. 12 is a fragmentary side sectional view of the prime and secondary sashes of FIG. 2 showing a corner lock and the secondary sash in the closed position.

Referring to FIGS. 11 and 12, the closure assembly 10 may include a breather system 60 formed of an air passage extending between the air chamber 62 and the exterior of the building structure, so that the air chamber 62 can communicate with outside ambient air. Breather systems are well known in the window and door construction industry. The breather system 60 can effectively prevent excessive moisture build-up, which results in condensation on an inner surface 64 of the prime glazing pane 30.

Figure 13A:
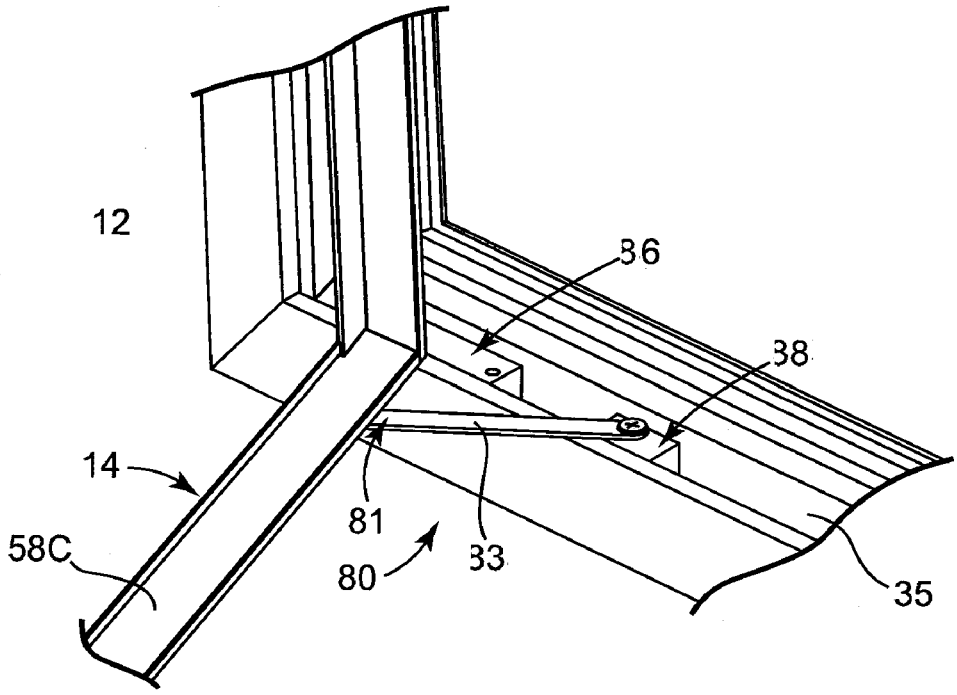
FIG. 13*a* is a side perspective view of the lower ends of a prime and secondary sash in accordance with the window assembly of FIG. 1 with the secondary sash in an open position to show a hinge mechanism connecting the secondary sash to the prime sash.
Figure 13B:
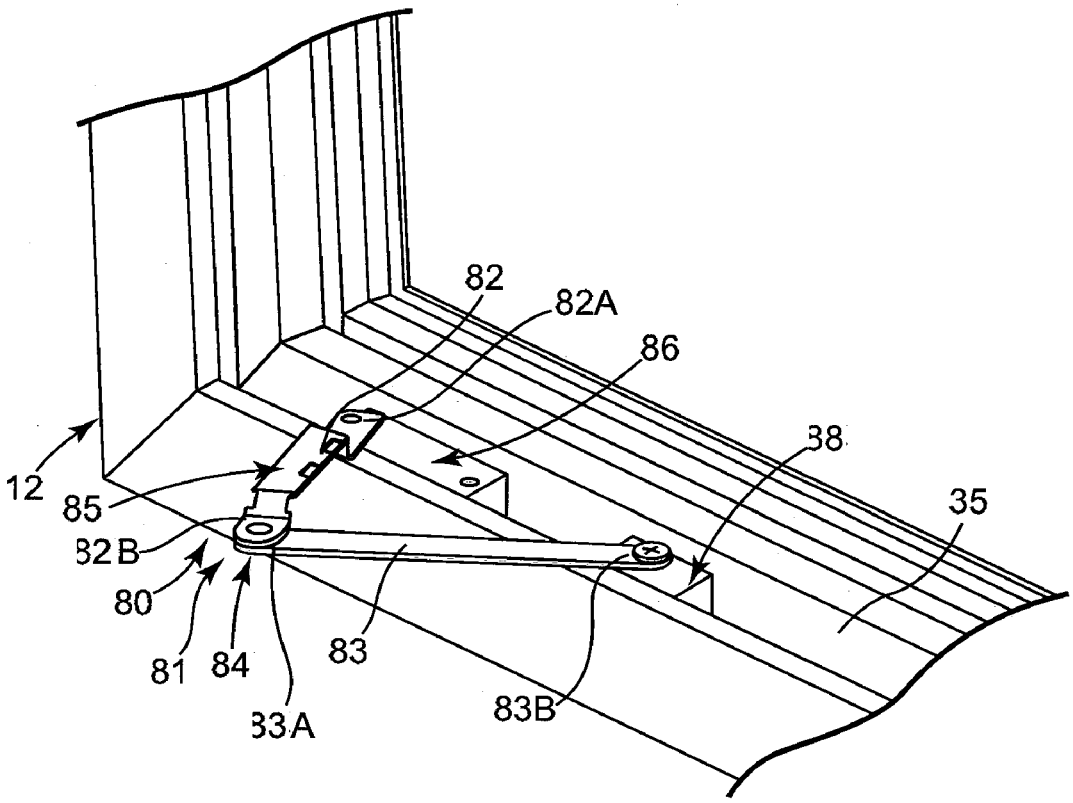
FIG. 13*b* is a side perspective view of the lower ends of the prime and secondary sashes of FIG. 13*a* with the secondary sash removed for clarity.
Figure 13C:
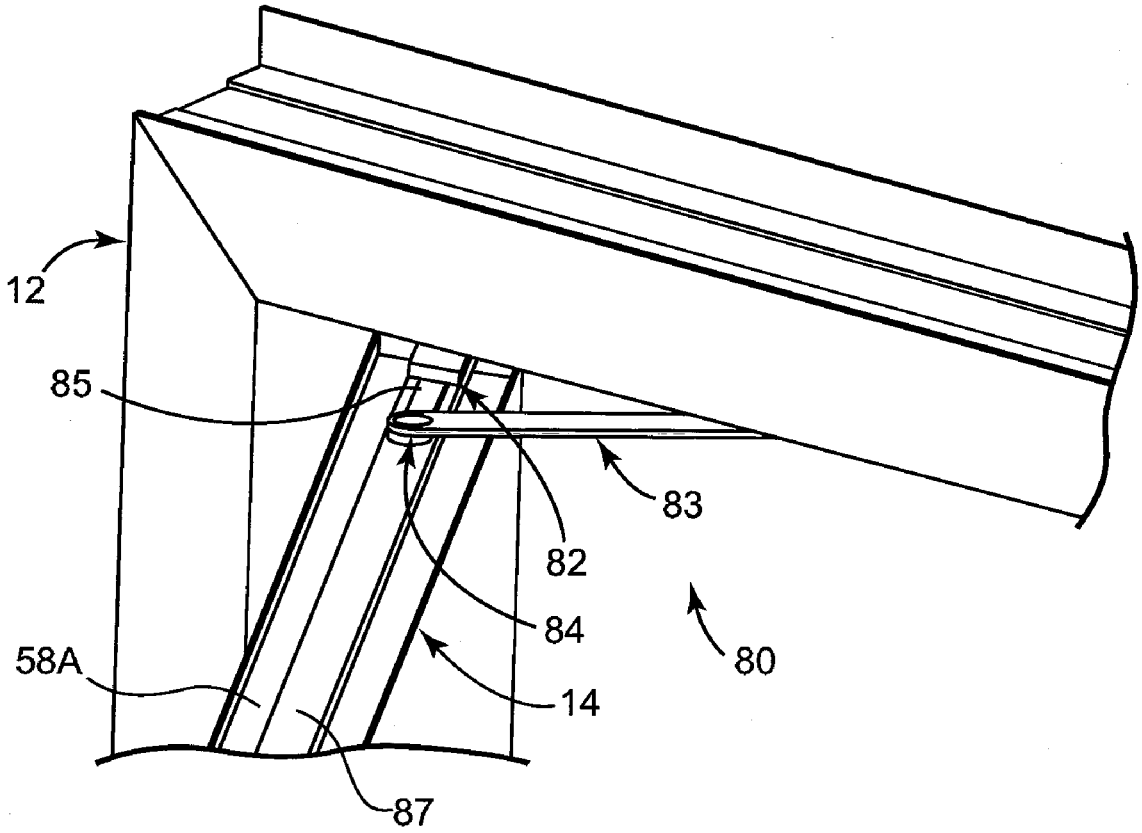
FIG. 13*c* is a side perspective view of the upper ends of the prime and secondary sashes of FIG. 13*a* with the secondary sash in an open position to show a hinge mechanism connecting the secondary sash to the prime sash.

Referring now to FIGS. 13 *a-c*, another embodiment of an opening limiting device 80 is shown coupled to the secondary sash 14 for limiting outward swinging of the secondary sash 14 with respect to the prime sash 12. FIG. 13*a* shows the opening limiting device 80 located at the sill member 58C. FIG. 13*b* shows the opening limiting device 80 of FIG. 13*a* with the secondary sash 14 removed for clarity. FIG. 13*c* shows an alternate embodiment in which the opening limiting device 80 is located at the head member 58A. As illustrated, the opening limiting device 80 may be located at either or both of the head member 58A and the sill member 58C of the secondary sash 14.

Opening limiting device 80 includes an arm 81 operatively connecting the prime sash 12 to the secondary sash 14. The arm 81 includes a first section 82 and a second section 83 pivotally connected together at point 84. As shown, a proximal end 82A of the first section 82 is pivotally attached to a slidable block 86 residing in the channel 35 extending along the inner periphery of the prime sash 12. First section 82 has a raised region 85 adapted to be received in a recessed region 87 formed in at least a portion of the external periphery of the secondary sash 14 (visible in FIG. 13*c*). The raised region 85 is retained in the recessed region 87 so that the first section 82 rotates or swings with the secondary sash 14, hidden from view. According to one embodiment, the raised region 85 is secured to the secondary sash 14 at the recessed region 87. According to other embodiments, the raised region 85 and recessed region 87 form an interference fit, but are not affixed to one another. A distal end 82*b* of the first section 82 is pivotally coupled to a proximal end 83A of the second section 83. A distal end 83B of the second section 83 is pivotally coupled to a second block 88 residing in and fixed to channel 35.

When the secondary sash 14 is in a closed position, the first block 86 is longitudinally displaced from the second block 88. The secondary sash 14 overlays the channel 35, blocking the opening limiting device 80 from view. When the secondary sash 14 is moved into an open position, first section 82 pivots outwardly, causing the second section 83 to draw the first block 86 proximally toward second block 88. Block 88 is stationary and prevents further travel of block 86, limiting the outward displacement of the secondary sash 14. Blocks 86 and 88 are sized so that second block 88 engages stationary first block 86 when the secondary sash 14 forms a 90° angle with respect to the prime sash 12.

The opening limiting device 80 prevents over-travel of the secondary sash 14, which condition can sometimes cause damage to the secondary sash 14 or window accessories. In other embodiments, the opening limiting device 80 is configured to permit maximum travel of the secondary sash 14 to an angle of 45°, 60° or 130° with respect to the primary sash 12. The opening limiting device 80 is preferably hidden from view when the secondary sash 14 is in the closed position, providing a neat appearance.

According to one embodiment, stationary block 88 and sliding block 86 reside in the channel 35 but are not attached to the prime sash 12. The secondary sash 14 remains fully removable from the prime sash 12. An interference fit between the stationary block 88 and the channel 35 pivotally attach the secondary sash 14 to the prime sash 12. According to one embodiment, the opening limiting device 80 pivotally hinges the secondary sash 14 to the prime sash 12. According to other embodiments, the secondary sash 14 is pivotally attached to the prime sash 12 via other means.

Figure 14:
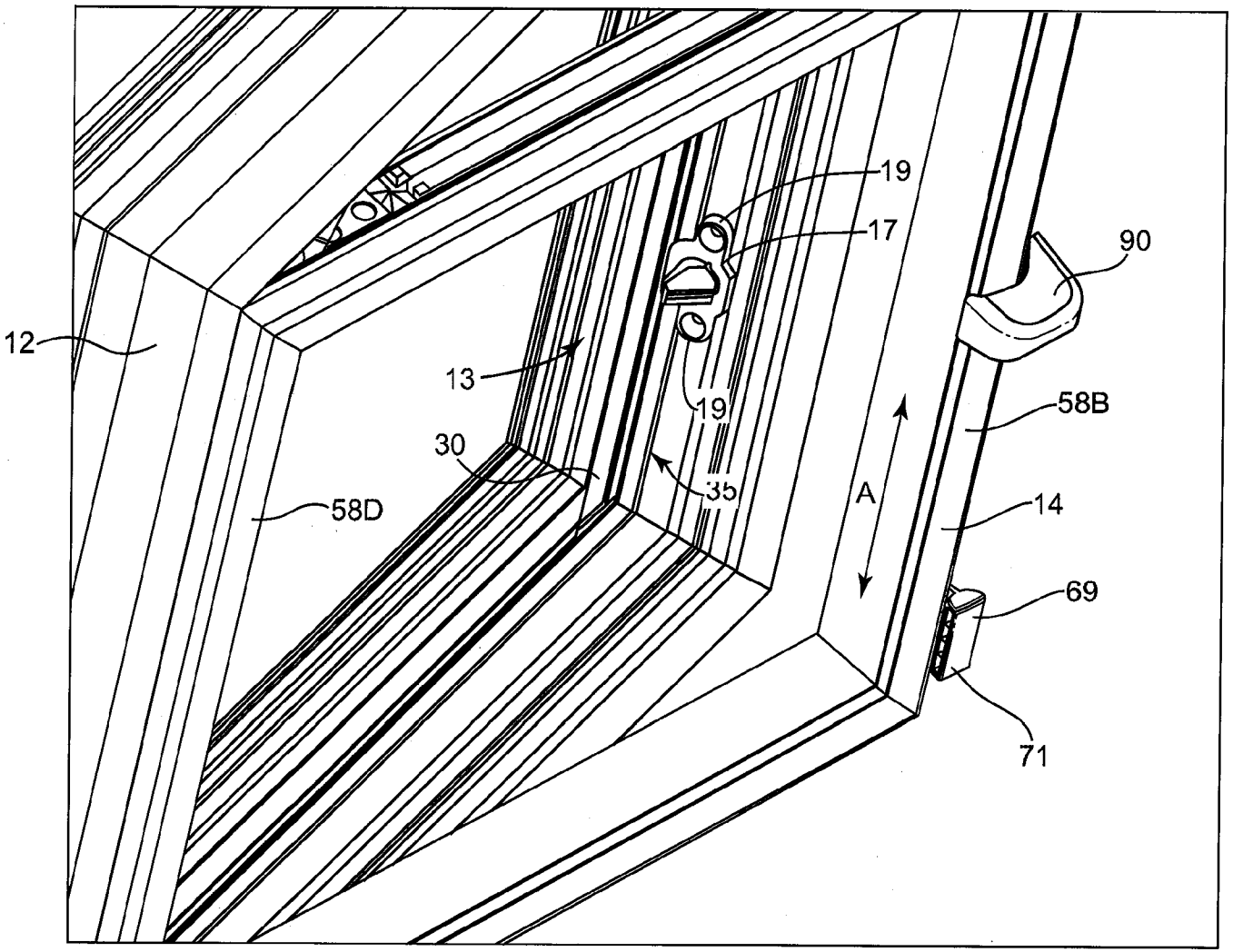
FIG. 14 is a side perspective view of a latching assembly for a secondary sash in accordance with the present invention.

FIG. 14 shows one embodiment of the latch mechanism(s) 13 for securing the secondary sash 14 in the closed position. A latch housing 17 is positioned on the inner periphery of the prime sash 12 in the channel 35. The latch housing 17 has a flange 19 with two holes therethrough to receive screws for fastening the housing 17 to the prime sash 12. The latch mechanism 13 is positioned on the opposite side of the prime sash 12 as the side on which the secondary sash 14 is hinged to the prime sash 12. In some instances a latch mechanism 13 may be installed on the two sides of the prime sash 12 adjacent to the hinged side of the secondary sash 14. In the illustrated embodiment, the secondary sash first stile 58D is hinged to the prime sash 12 and the latch mechanism 13 latches the second stile 58B of the secondary sash 14 to the prime sash 12. When in the closed and latched position, the secondary sash 14 compresses gasket 76 (not visible) to form a seal with the prime sash 12.

Figure 15:
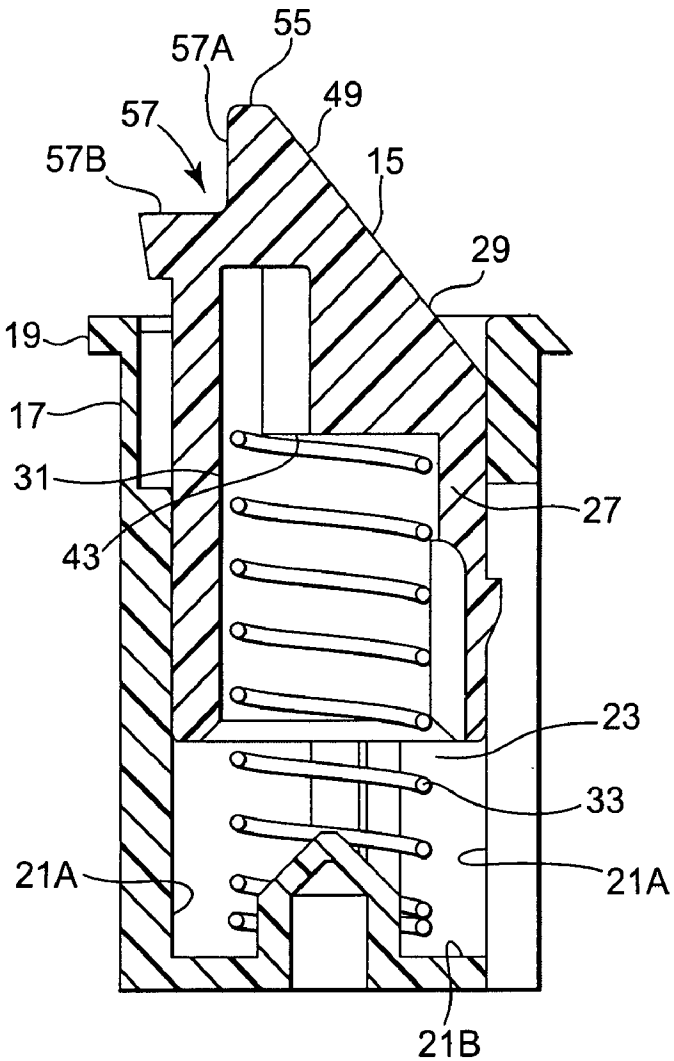
FIG. 15 is a top view of the latching assembly of FIG. 1 with the prime sash and secondary sash removed for clarity.
Figure 16:
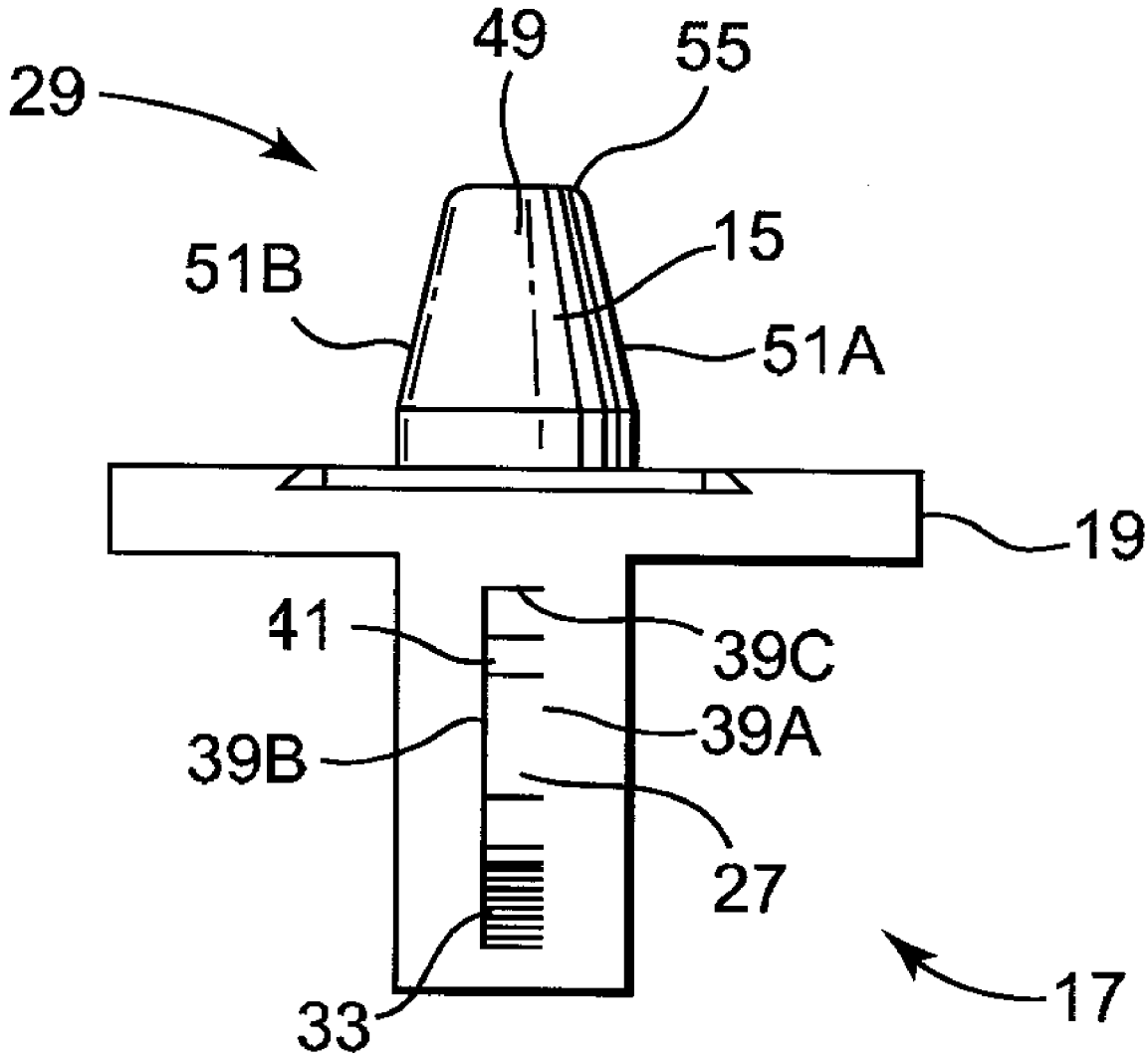
FIG. 16 is a side view of the latching assembly of FIG. 15.

Referring now to FIGS. 15 and 16, the latch housing 17 has a cylindrical side wall 21A and a back wall 21B defining an interior chamber 23 for receiving a retractable latching element 15. The latching element 15 has a rearward portion 27 generally residing within the chamber 23 and a beveled portion 29 generally protruding from the housing 17. The rearward portion 27 is hollow and has an interior surface 31 provided with an inner ledge 43. A spring 33 is positioned inside the chamber 23 between the latching element 15 and the back wall 21B. The spring 33 resiliently biases the latching element 15 outwardly so that the beveled portion 29 protrudes from the latch housing 17. The spring 33 is sized to fit within the rearward portion 27 of the latching element 15 and engage the inner ledge 43 so that the latching element 15 is fully displaceable to the back wall 21B of the chamber 23 such that the beveled portion 29 is fully withdrawn into chamber 23. The latch housing 17 and latching element 15 are oriented so that the latching element 15 is displaceable along an axis perpendicular to the arcuate motion of the secondary sash 14 as it moves from closed position to an opened position.

Referring now to FIG. 16, side surfaces 39A, B and C define a slot 39 extending longitudinally along the latch housing 17. The rearward portion 27 of the latching element 15 is provided with a protrusion 41 slidable along the slot 39. Surfaces 39A and 39 B engage the protrusion 41 to prevent rotation of the latching element 15 with respect to the latch housing 17. Surface 39C forms a stop to prevent disengagement of the latching element 15 from the latch housing 17.

In the illustrated embodiment, the beveled portion 29 of the latching element 15 is characterized by three arcuate surfaces. A first surface 49 is beveled or sloped to form an oblique angle with respect to the plane of the prime sash 12. A second surface 51A and a third surface 51B oppose one another on either side of the first surface 49. The second and third surfaces 51A, 51B are beveled or sloped to form oblique angles with respect to an axis "A" of secondary sash member 58B (See FIG. 1), also described as second stile 58B. Surfaces 49, 51A and 51B form a foreshortened and elongated apex 55 on the latching element 15 extending generally parallel to the secondary sash member 58B. Surfaces 57A and 57B form a notch 57 in the apex 55 oriented towards the outer region of the window assembly 10, or away from the secondary sash 14. Surfaces 57A and 57B form an angle slightly greater than 90° with respect to one another.

Figure 17:
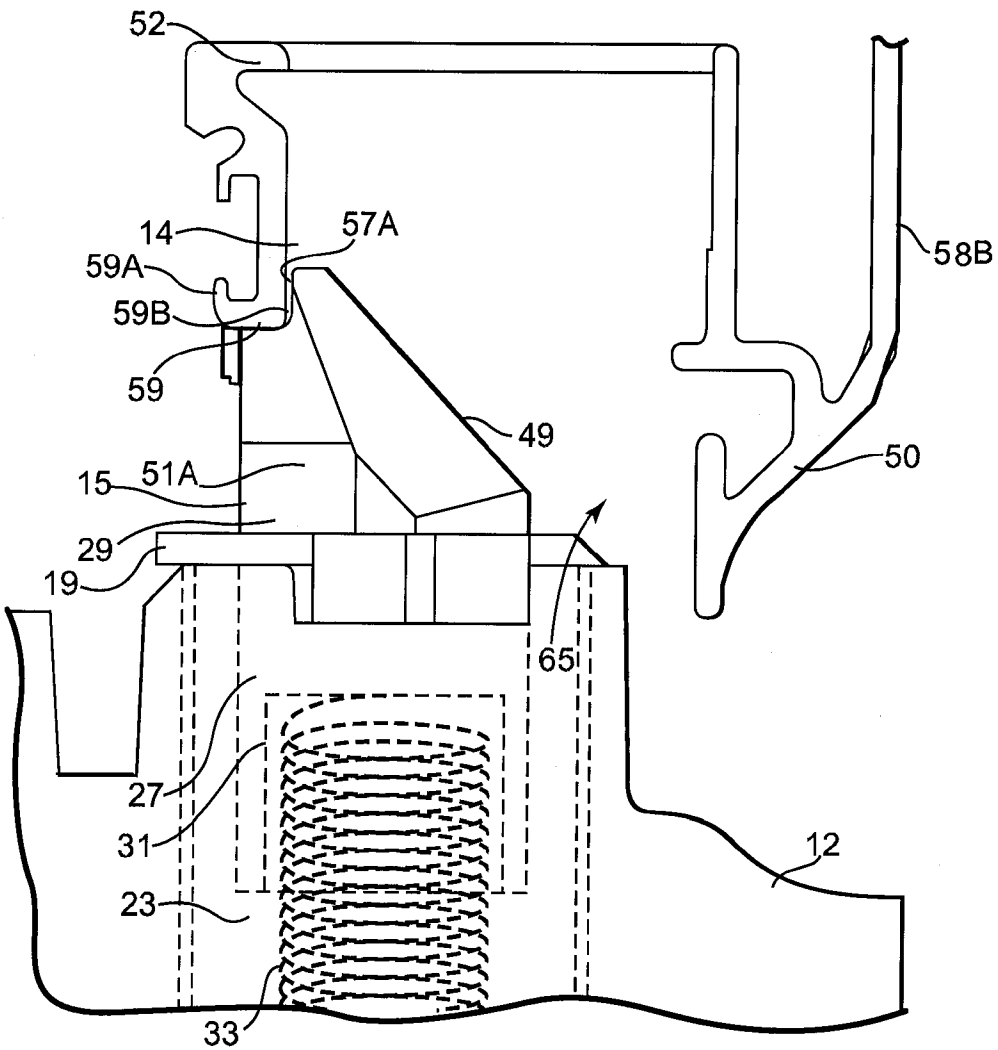
FIG. 17 is a top view of the latching assembly of FIG. 14 with the secondary sash in a closed position.

Referring now to FIG. 17 , at least a portion of the interior portion 52 of the secondary sash 14 is provided with a lip 59 adapted to engage the notch 57 to secure the secondary sash 14 to the prime sash 12. When the secondary sash 14 is moved from the open position to the closed position, a leading edge 59A of the lip 59 engages the first surface 49 of the beveled portion 29. The leading edge 59A of the lip 59 slides across the first surface 49, displacing the latching element 15 into the chamber 23. When the lip 59 has moved past the apex 55 (FIG. 16), the latching element 15 is released and biased outwardly by the spring 33. A small radius at the apex 55 of the latching element 15 and a radius at the edge of lip 59 serve to force the latching element 15 away from surface 57A, as the spring 33 forces the latching element 15 outwardly. This rearward motion helps to force the latching element 15 tightly against the side surfaces of the chamber 23. When the latching element 15 is forced tightly against the side surface of the chamber 23, an opening motion of the secondary sash 14 will be reduced after the latching element 15 has been forced outwardly. This same radii at the apex 55 and at the edge of lip 59 serves to cam the surface 57A of the latching element 15 away from surface 59B slightly before surfaces 57A and 59B have been moved into the same plane. This reduces the distance that the secondary sash 14 needs to be compressed into the primary sash 12 to achieve the latching function. The side 57A of the notch 57 engages a trailing edge 59B of the lip 59 to securely latch the secondary sash 14 to the prime sash 12.

In the closed and latched position, the secondary sash 14 compresses the gasket 76 to provide an air tight seal between the secondary sash 14 and the air chamber 62. Sometimes secondary sash 14 is subject to wind loading and other stress forces when in the closed position and engaging the latch mechanism 13. Such stresses can deform the secondary sash 14 over time, and causes general wear and tear on the latching mechanism 13. However, because the notch 57 has a greater than 90° angle, there is some slack between the notch 57 and the seated lip 59 when the secondary sash 14 is in the closed position. This slack permits some movement of the secondary sash 14 relative to the latch element 15 while the secondary sash 14 is in the closed position. In particular, the slack between the notch 57 and the lip 59 permits the secondary sash 14 to move slightly in response to wind loading without deforming the gasket 76. This feature can reduce wear and tear on the gasket 76 and contribute to a longer component life.

The latch mechanism 13, and in particular the latch element 15, may include a lubricant rendering the part hydrophobic. This may be done to reduce water absorption and swelling which would interfere with latch performance.

Figure 18:
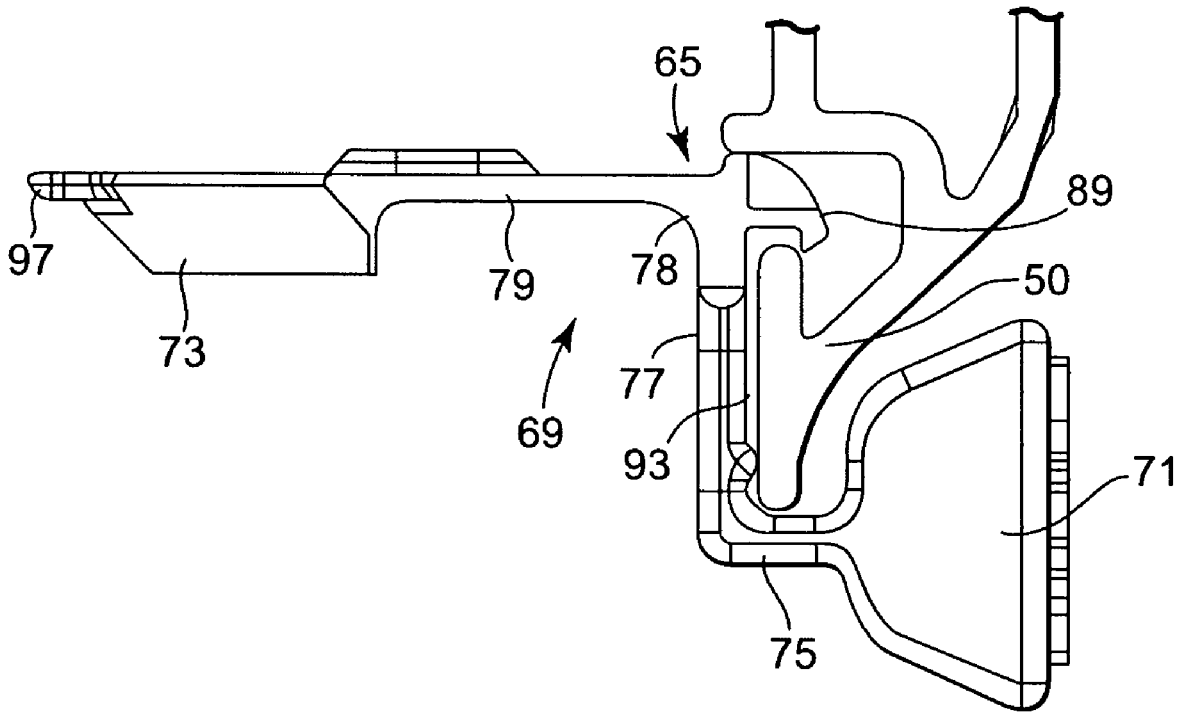
FIG. 18 is a top view of the sliding operator installed on the secondary sash.
Figure 19:
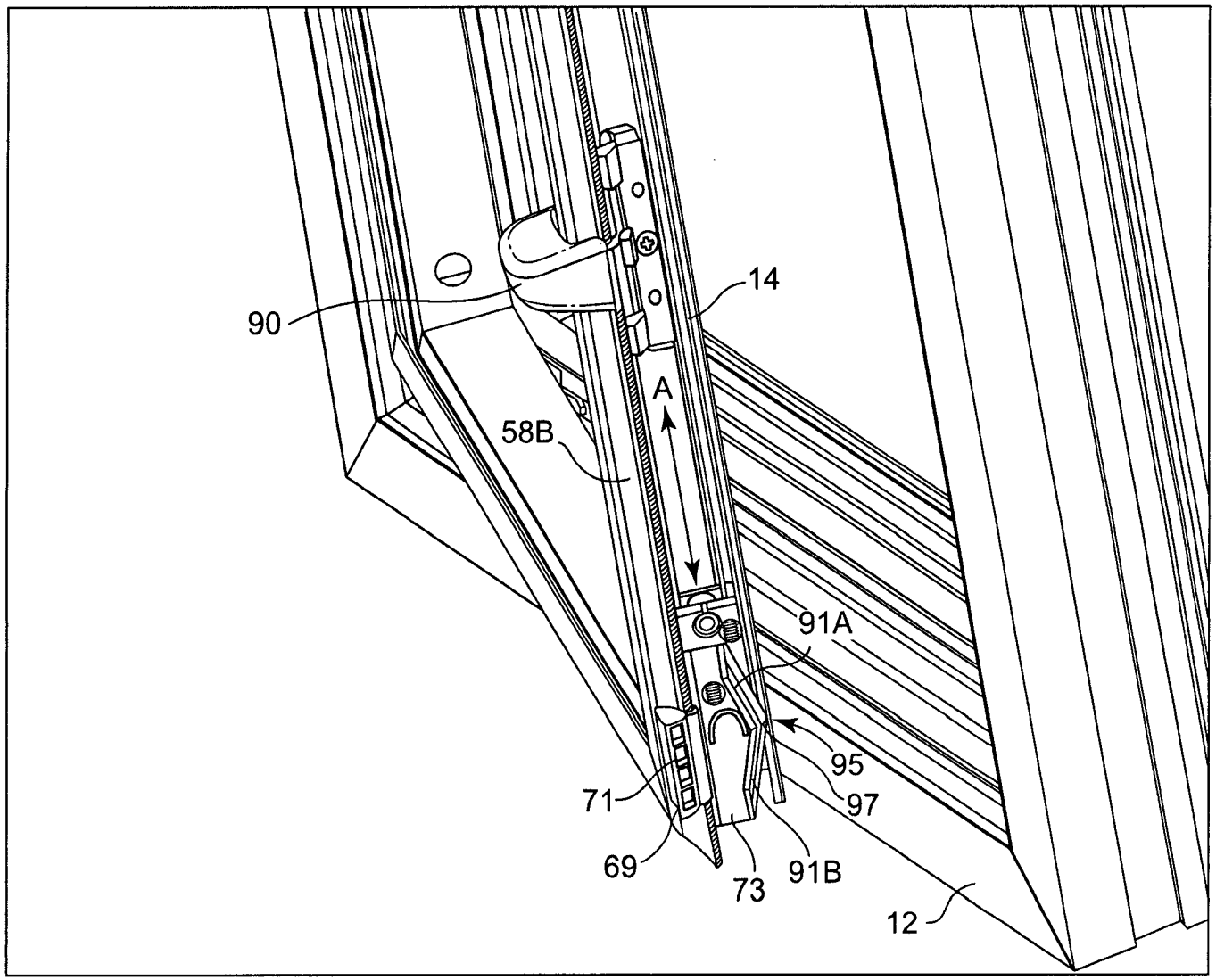
FIG. 19 is a side perspective view of the sliding operator of FIG. 18 installed on the secondary sash.

The closure assembly 10 further includes a release mechanism or sliding operator 69 for unlatching the secondary sash 14 from the prime sash 12. As shown in FIGS. 18-19, the sliding operator 69 is slidably coupled to the secondary sash member 58B. The sliding operator 69 has a handle 71 accessible from the inner region of the closure assembly 10 and wing 73 positioned in between the inner periphery of the prime sash 12 and the outer periphery of the secondary sash 14. The handle 71 is operably connected to the wing 73 via an arm 65 having a series of angled members. The arm 65 includes a first arm member 75 extending from the handle 71, a second arm member 77 extending at an angle from the first arm member 75, and a third arm member 79 extending at an angle from the second arm member 77. The first arm member 75, second arm member 77 and third arm member 79 are angled relative to one another to position the wing 73 in between the inner periphery of the prime sash 12 and the outer periphery of the secondary sash 14.

The second arm member 77 and the third arm member 79 meet at a junction 78. The junction 78 is provided with an elongated hook 89 extending generally parallel to the first arm member 75. The first arm member 75, second arm member 77 and hook 89 form an open sleeve 93 adapted to receive and retain the periphery portion 50 of the secondary sash 14 to slidably couple the sliding operator 69 to the secondary sash member 58B. Referring now to FIG. 19, the wing 73 has two wing members 91A and 91B angled with respect to one another and forming an apex 95. The apex 95 is formed with a protrusion 97 extending towards the outer region of the window assembly 10. The sliding operator 69 may be a generally unitary construction or may have to be a two piece part, configured to snap together to lock the part into sliding engagement with the periphery portion 50 of the secondary sash 14.

Figure 20:
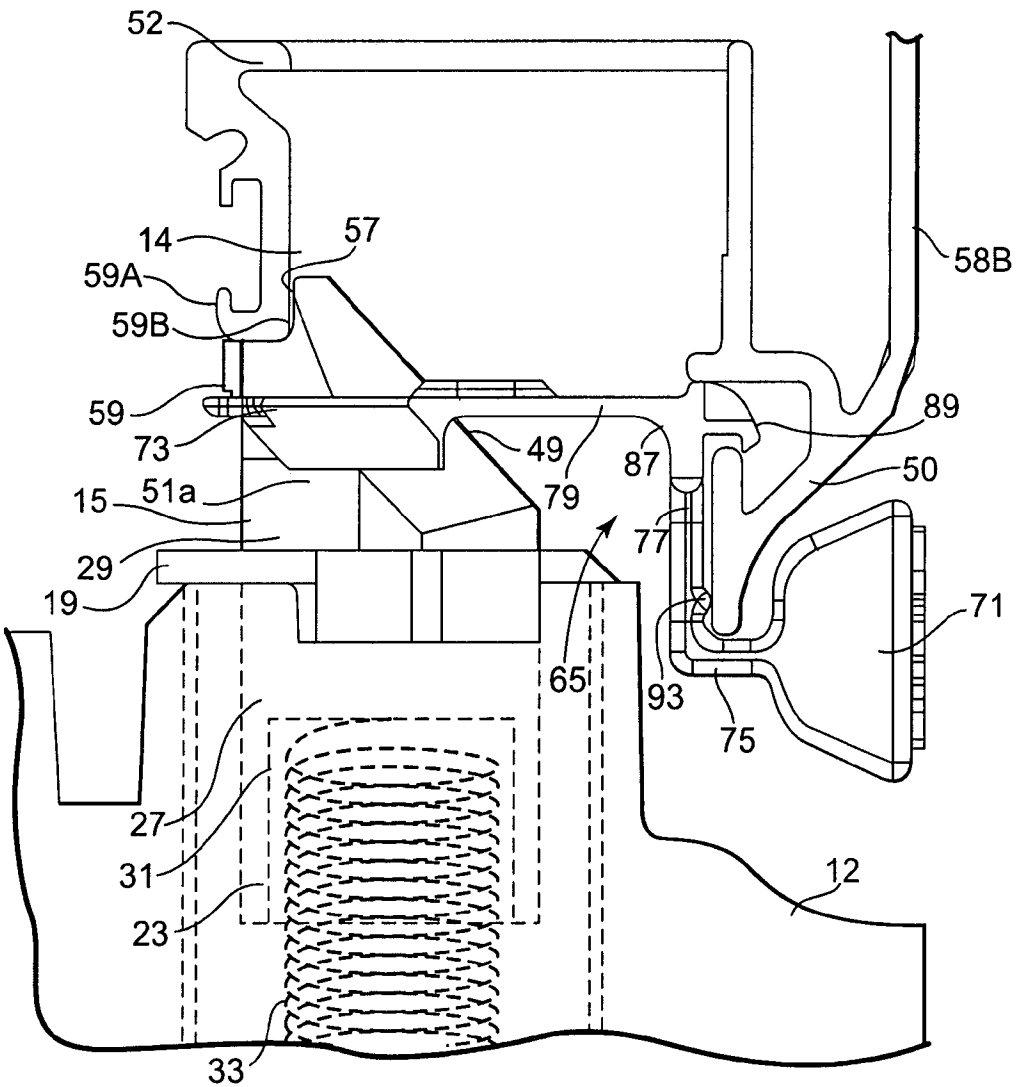
FIG. 20 is top view of the latching assembly of FIG. 14 installed on the prime sash and secondary sash.

Referring to FIGS. 19 and 20, the sliding operator 69 is operable to unlatch the secondary sash 14 from the prime sash 12. When the secondary sash 14 is in the closed position and latched to the prime sash 12, the sliding operator 69 is slid past the protruding latching elements 15. Wing member 91A engages the second surface 51A of the latching element 15. Wing member 91A slides along the second surface 51A, displacing the latching element 15 into the chamber 23. The wing protrusion 97 also engages the second surface 51A to disengage the latching element 15 from the lip 59 of the secondary sash 14. Displacement of the latching element 15 disengages the notch surface 57A from the lip 59 of the secondary sash 14 to release the latch mechanism 13. The gasket 76 is released as well, biasing the secondary sash 14 away from the latching element 15.

As shown in FIG. 1, according to one embodiment, the closure assembly 10 is provided with multiple latch mechanisms 13 along second stile 58B. Each of the individual latch mechanisms 13 engages the second stile 58B as the secondary sash 14 is moved to the closed position. When the secondary sash 14 is to be moved back to an open position, a single sliding operator 69 is operable to disengage each latch mechanism 13 sequentially. Furthermore, as the sliding operator 69 slides past and releases each latch mechanism 13, the compressed gasket 76 biases the secondary sash 14 outwardly and away from the latch mechanism 13. In this manner, individual latch mechanisms 13 are prevented from inadvertently re-engaging the lip 59 before the secondary sash 14 is moved into a more fully open position. In this manner, multiple latch mechanisms 13 are sequentially unlatched in a single sliding motion of the sliding operator 69.

Opposing wing members 91A, 91B are operable to engage either of the second surface 51A or the third surface 51B of the latching element 15. The sliding operator 69 is thus operable to disengage the latch mechanism 13 with sliding motion in either direction along the axis A of the secondary sash member 58B. It is not necessary to locate the sliding operator 69 in a particular position on the secondary sash member 58B with respect to the latch mechanism 13 to permit operation of the sliding operator 69.

According to one embodiment, window closure 10 is provided with multiple latch mechanisms 13 and multiple sliding operators 69. The sliding operators 69 are located on either side of a handle 90 (FIG. 14) positioned on the secondary sash 14 for actuating a between the glass type window covering residing between the prime sash 12 and the secondary sash 14. Each sliding operator 69 is slidable along the length of the secondary sash member 58B between the head member 58A and the handle 90 or the sill member 58C and the handle 90, respectively.

According to other embodiments, the latch housing 17 may be positioned on the secondary sash 14 to engage a protruding feature of the prime sash 12 or the frame 16. According to still other embodiments, the sliding operator 69 may be slidably coupled to the prime sash 12 or the frame 16 to engage a latch mechanism 13 positioned on either of the secondary sash 14, the prime sash 12 or the frame 16.

Figure 21:
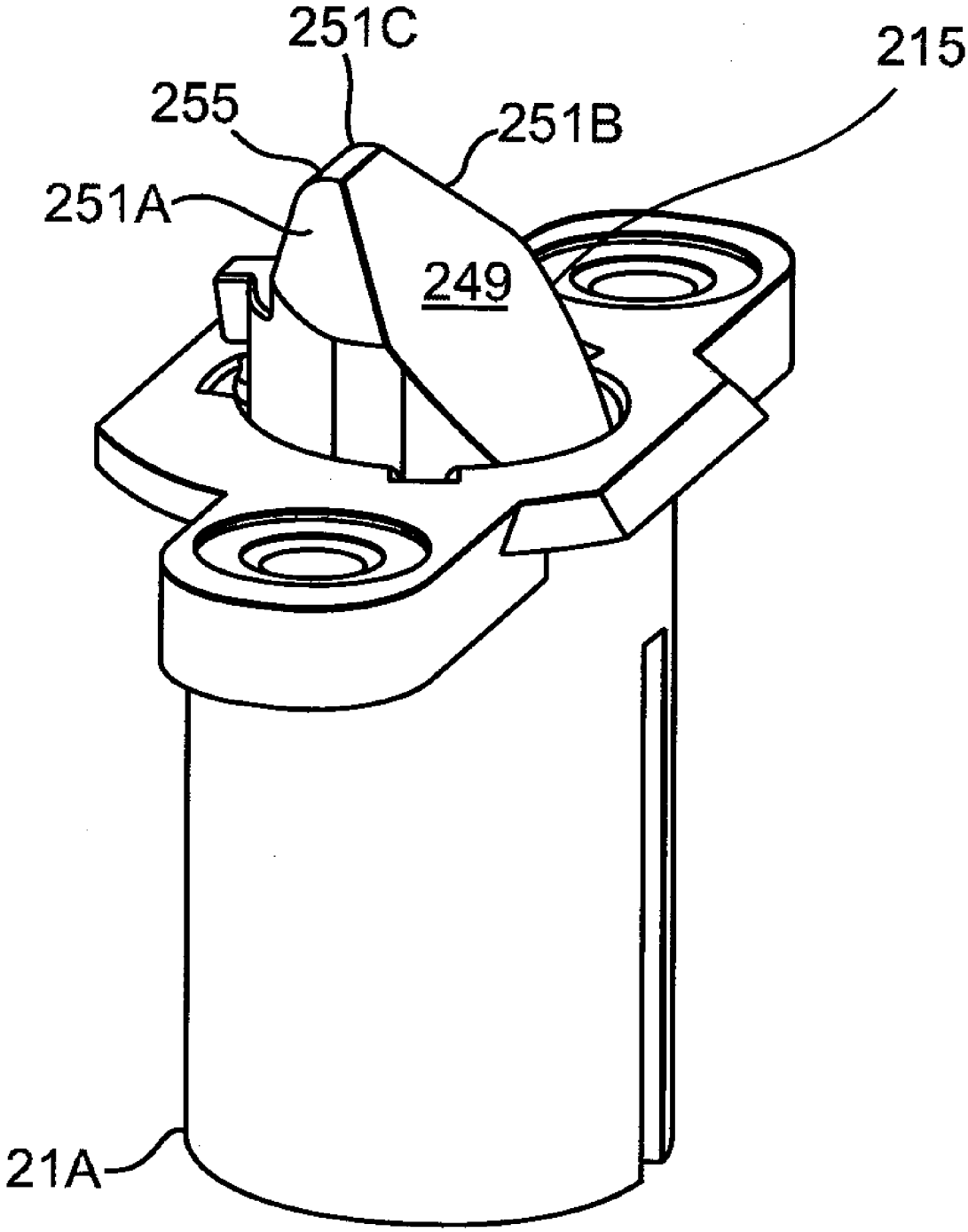
FIG. 21 is a front perspective view of a latching assembly according to another embodiment of the present invention.
Figure 22:
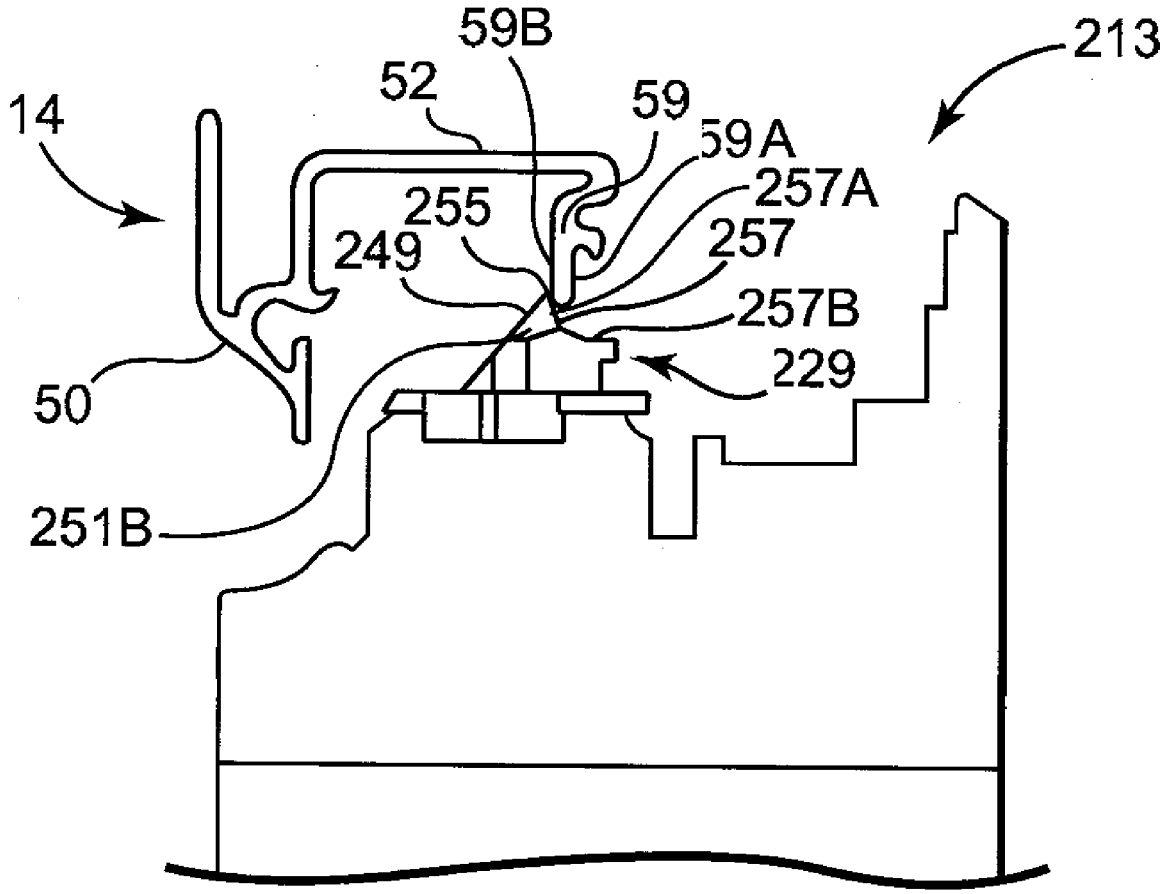
FIG. 22 is a top view of the latching assembly of FIG. 21 installed on the prime sash.

A latch mechanism 213 according to another embodiment of the present invention is shown in FIGS. 21 and 22. The latch mechanism 213 is generally similar to latch mechanism 13 and like parts are given like numbering preceded by a "2". In contrast to arcuate surfaces 49, 51A and 51B, the beveled portion 229 of the latching element 215 is characterized by several planar surfaces angled with respect to one another. A first surface 249 extends at an oblique angle with respect to the plane of the prime sash 12. Opposing planar second and third surfaces 251A, 251B form oblique angles with respect to the axis "A" of the secondary sash member 58B and with respect to the axis of displacement of the latching element 215. A fourth surface 251C forms an apex 255 of the latching element 215 and extends generally perpendicular to the axis of displacement of the latching element 215. Surfaces 257A and 257B define a notch 257 in the apex 255 opposite the surface 249. Surfaces 257A and 257B form an angle of at least about 90°. According to one embodiment, surfaces 257A and 257B form an angle of about 100°.

When the secondary sash 14 is moved from the open position to the closed position, a leading edge 59A of the lip 59 engages the first surface 249 of the beveled portion 229. The leading edge 59A of the lip 59 slides across the first surface 249, displacing the latching element 215. When the lip 59 has moved past the apex 255, the latching element 215 is released and biased outwardly. The side 257A of the notch 257 engages a trailing edge 59B of the lip 59 to securely latch the secondary sash 14 to the prime sash 12. In the closed and locked position, the secondary sash 14 compresses the gasket 76 to provide an air tight seal between the secondary sash 14 and the air chamber 62.

Although not shown, latch mechanism 213 is released in generally the same manner as latch mechanism 13. The sliding operator 69 is slid past the protruding latching element 215 to release the latch mechanism 213. Sliding past, wing member 91A engages either of the second or third surfaces 251A, 251B of the latching element 215, displacing the latching element 215 into the chamber 23. The wing protrusion 97 also engages the same of the second or third surfaces 251A, 251B to disengage the latching element 215 from the lip 59 of the secondary sash 14. Displacement of the latching element 215 disengages the notch surface 257A from the lip 59 of the secondary sash 14 to release the latch mechanism 13. The gasket is released as well, biasing the secondary sash 14 away from the latch mechanism 13.

Figure 23A:
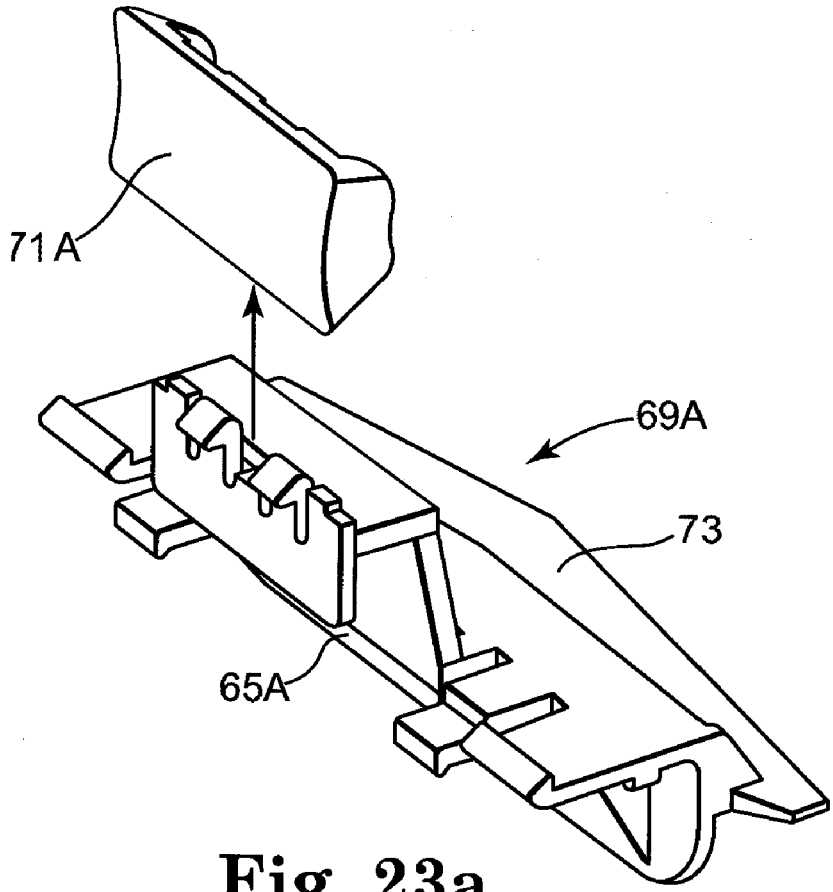
FIG. 23*a* is a side perspective view of a disassembled sliding operator according to another embodiment of the present invention.
Figure 23B:
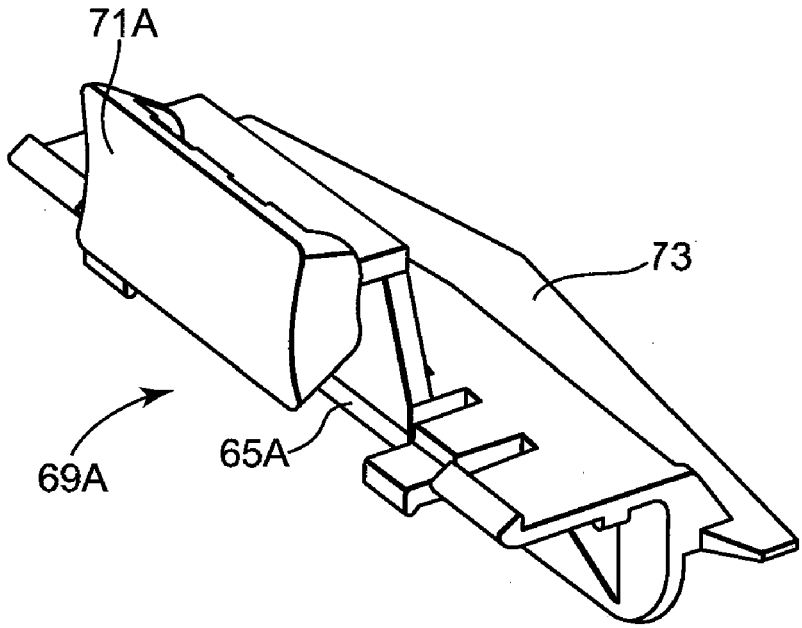
FIG. 23*b* is a side perspective view of the sliding operator of FIG. 23*a* in an assembled configuration.
Figure 24:
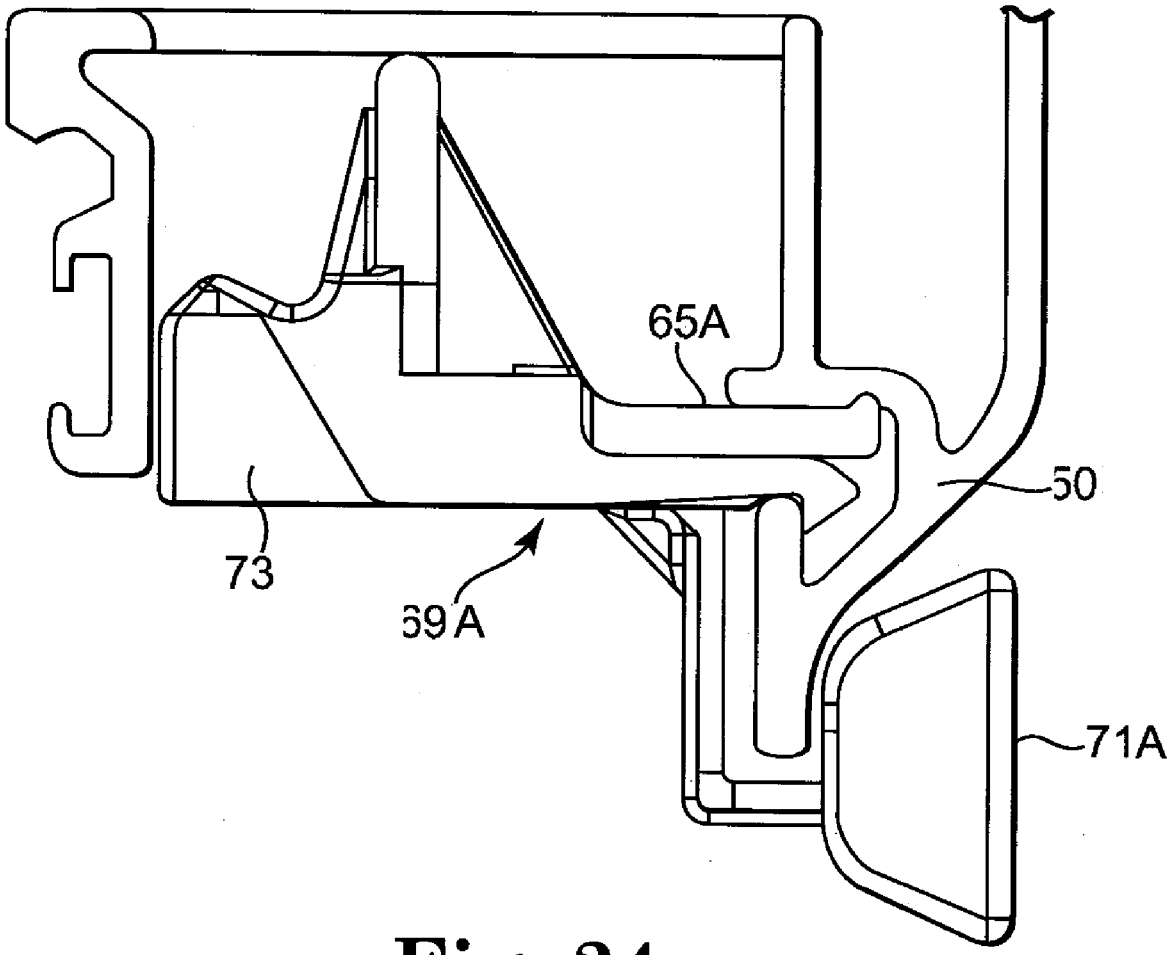
FIG. 24 is a top view of the sliding operator of FIGS. 23*a*-*b* installed on the secondary sash.

FIGS. 23*a*-23*b* show a sliding operator 69*a* according to another embodiment of the present invention. Sliding operator 69*a* is generally similar to sliding operator 69 as shown in the preceding figures. However, as is shown in FIG. 23*a*, sliding operator 69*a* has a two-part construction in which the handle 71*a* is detachably coupled to the arm 65*a*. In the present embodiment, the handle 71*a* is snap-fit to the arm 65*a*. FIGS. 23*a*-24 illustrate another difference, in that the sliding operator 69, including the wings 73, has a greater height along the sliding axis. This configuration is believed to provide an improved unlatching force, reducing the amount of force the operator is obliged to exert to release the latch mechanism 13.

Figure 25:
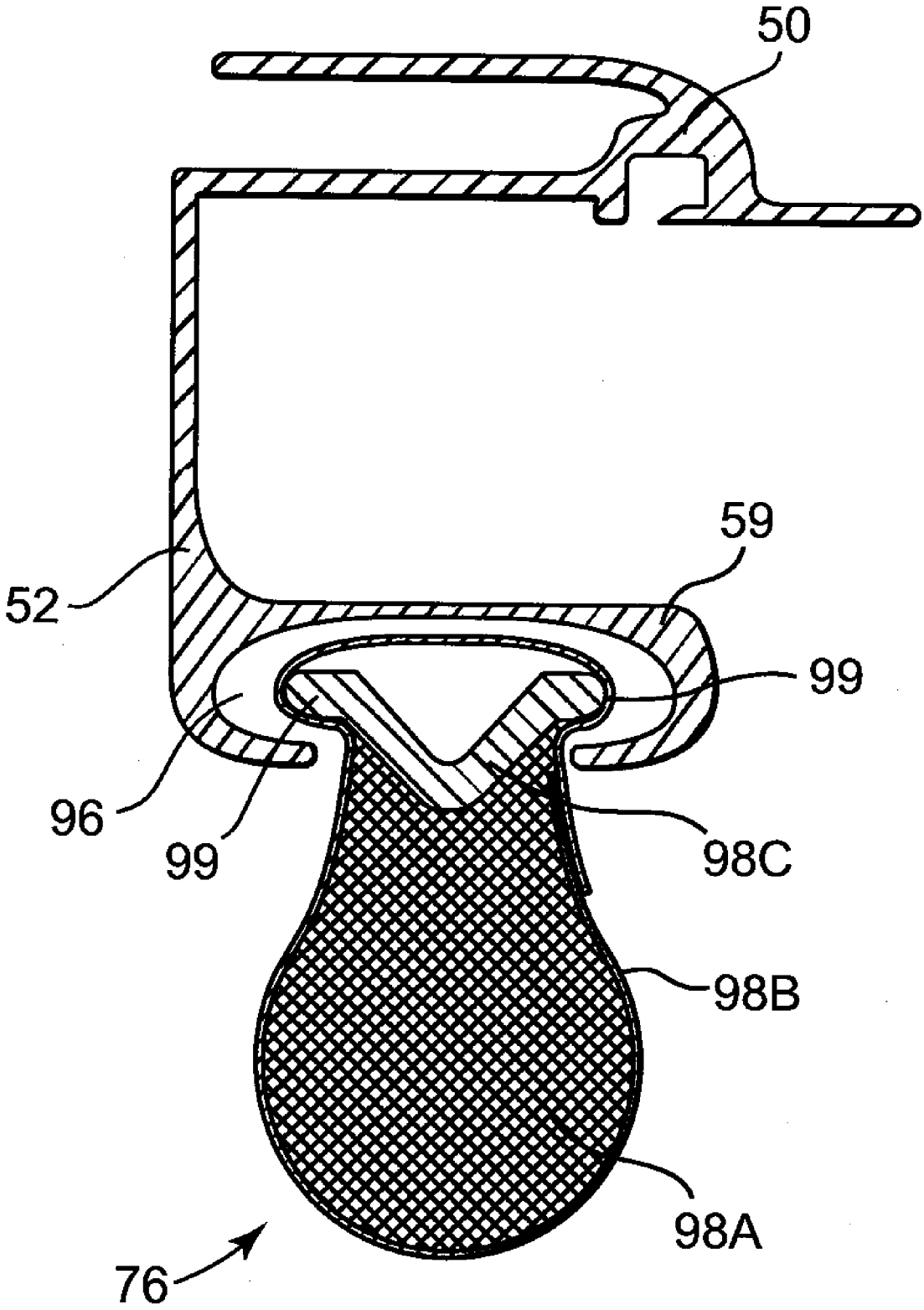
FIG. 25 is a cross-sectional view of the secondary sash of FIG. 14 detailing a sealing gasket.

FIG. 25 shows the gasket 76 mounted to the secondary sash 14. As discussed previously, the gasket 76, or other such compressible member compressed by the secondary sash 14 when in a closed and latched position, performs dual functions. The gasket 76 forms a seal between the secondary sash 14 and the prime sash 12, improving the insulating capabilities of the window assembly 10. The gasket 76 also has resilient qualities, such that it biases the secondary sash 14 to an open position. The gasket 76 is alternately placed around the inner periphery of the prime sash 12.

The lip 59 extending from the interior portion 52 is formed with a channel 96 shaped like a "C" extending along its length. According to one embodiment, the channel 96 extends along all of the secondary sash 14 frame members 58A-D. The gasket 76 is formed of an insulating filler 98A encased in a cover 98B and mounted to a base 98C. The base 98C has an inverted V-shape and is provided with opposing legs 99 protruding in opposite directions. According to one embodiment, the base 98C is made of a rigid polypropylene. According to one embodiment, the filler 98A is made of a heat resilient urethane foam. According to one embodiment, the cover 98B is made of polyethylene. The cover 98B and filler 98A are mounted to the base 98C and extend therefrom. The cover 98B and filler 98A bulge slightly, such that the cover 98B and filler 98A have an inverted tear-drop shaped cross-sectional shape. The gasket 76 is inserted into the channel 96 such that the opposing legs 99 form an interference fit with the channel 96. According to one embodiment, the gasket 76 is also adhered to the channel 96 to prevent inadvertent removal or repositioning. The gasket 76 is adapted to bend and conform to the shape of the secondary sash 14 as it extends through the channel 96.

The inverted v-shape of the base 98C allows the opposing legs 99 to be compressed to a width small enough to allow the opposing legs 99 to be inserted directly into the c-shaped channel 96 rather than be slid into the channel 96. Further, the inverted v-shape of the base 98C allows the gasket 76 to be bent around the corners of the secondary sash 14 where the frame members 58A-D meet with reduced distortion to the opposing legs 99. The reduced distortion permits an improved seal between the gasket 76 and the secondary sash 14.

Figure 26:
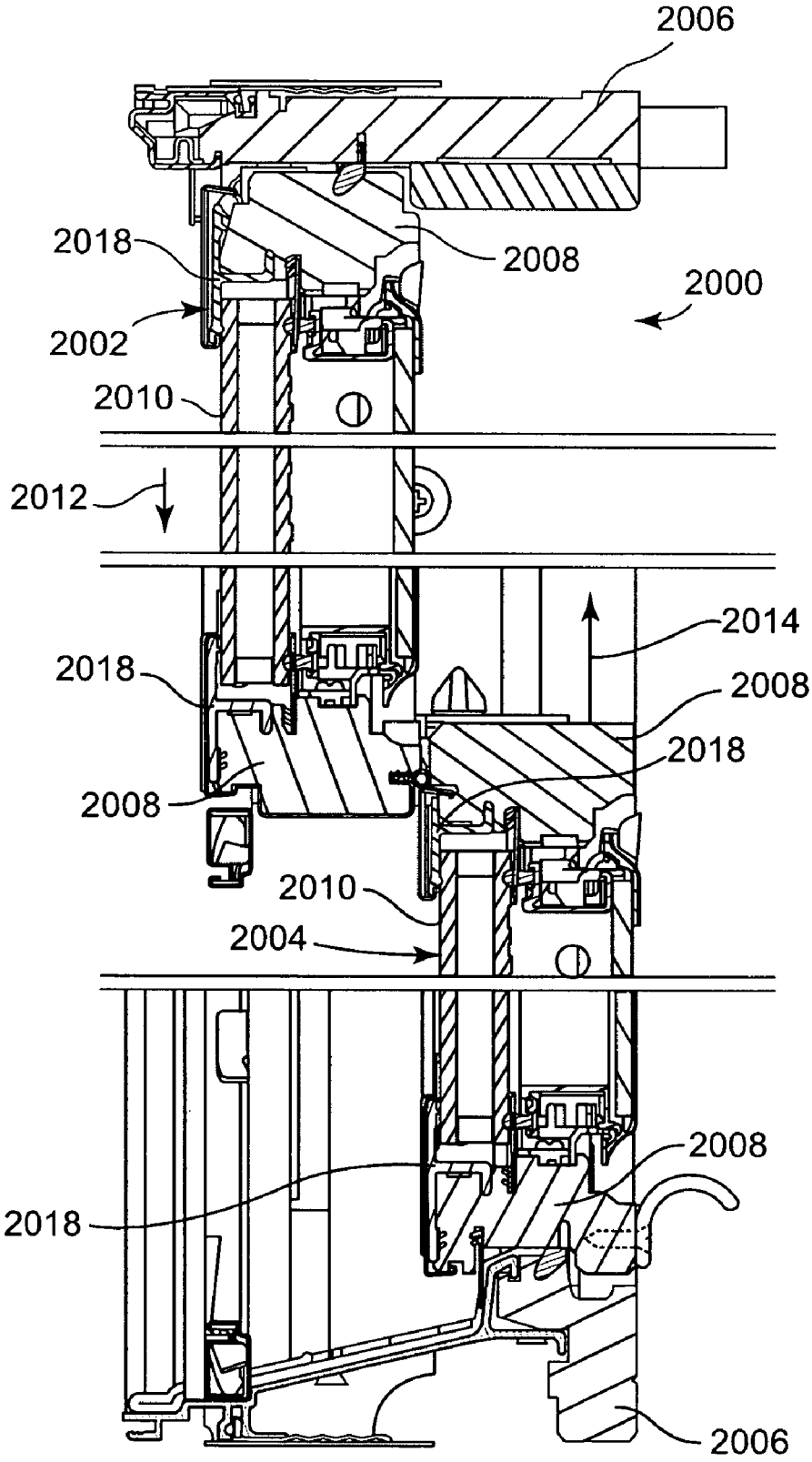
FIG. 26 is a side sectional view of a double hung window with a secondary sash in accordance with the present invention.
Figure 27:
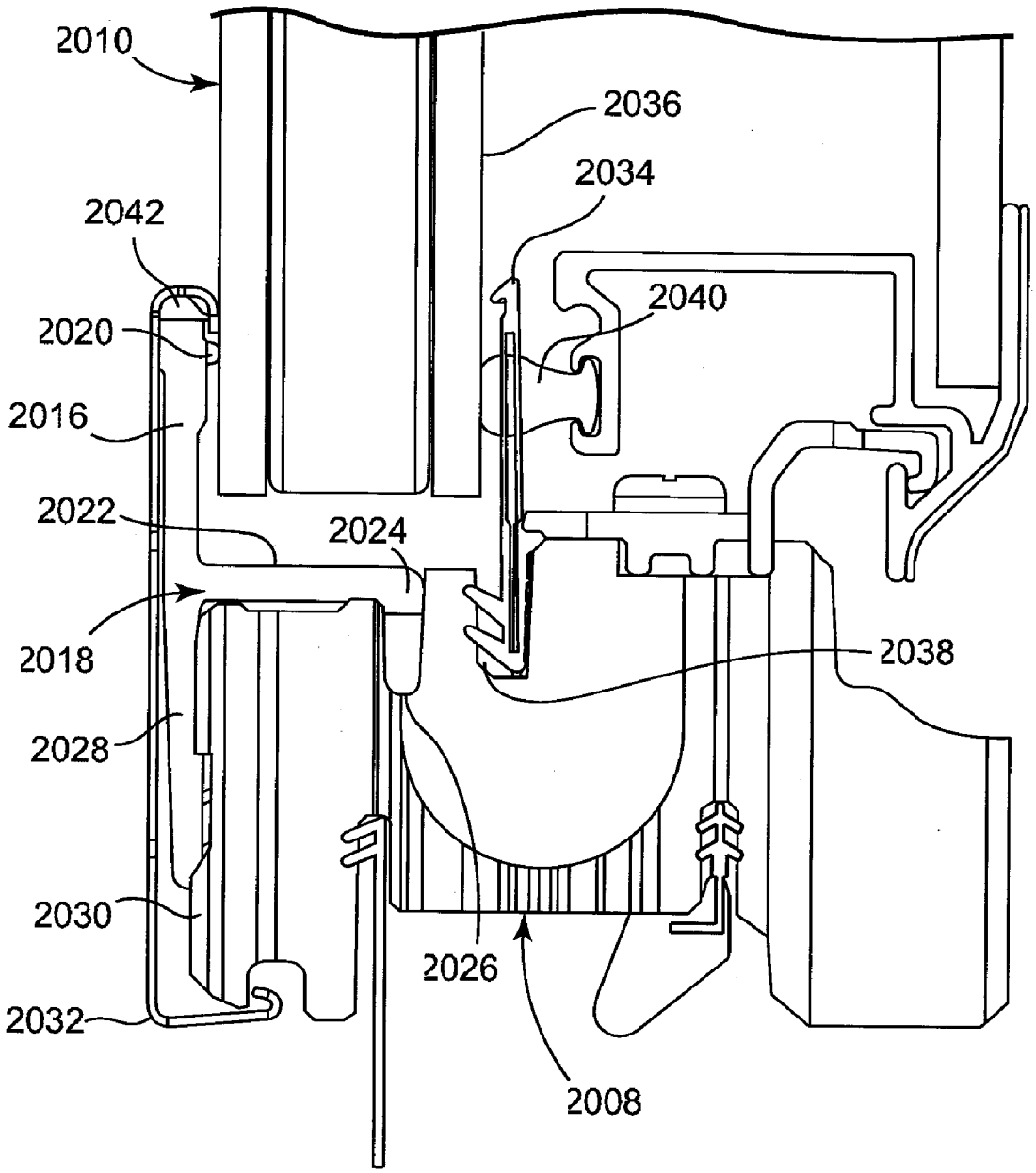
FIG. 27 is an enlarged view of a sash member with a glazing flange in accordance with the present invention.

As discussed above, the secondary sash 14 can be used with any style window, including double hung, awning, casement, transom and fixed windows. FIGS. 26 and 27 illustrate a window assembly 2000 having an upper prime sash 2002 and a lower prime sash 2004 arranged in a double hung configuration within a window frame 2006. The prime sashes 2002, 2004 include a plurality of sash members 2008 forming a perimeter frame for the prime glazing panels 2010. In the illustrated embodiment, the prime glazing panels 2010 comprise an insulated glass assembly with a pair of glazing panels. Also in the illustrated embodiment, glazing flange 2018 is located around the perimeter of the prime glazing panels 2010.

Secondary sashes 14 are attached to each of the prime sashes 2002, 2004 at the interior side I. The secondary sashes 14 are substantially the same as discussed above, including being hinged to open toward the interior side I.

In the embodiment of FIG. 26, the upper prime sash 2002 is adapted to slide downward along a direction 2012. The lower prime sash 2004 is adapted to slide upward along a direction 2014. In either situation, the secondary sashes 14 move along with the prime sashes 2004, 2006 without obstructing one another.

FIG. 27 is an enlarged cross-sectional view of one of the sash member 2008 of FIG. 26. In the present embodiment, the prime glazing panel 2010 is attached to upper member 2016 of the glazing flange 2018 using adhesive 2020. The glazing flange 2018 is preferably an extruded polymeric member designed to interlock with the sash members 2008. In the illustrated embodiment, the glazing flange 2018 includes a cross member 2022 with an extension 2024 that extends into recess 2026 of the sash member 2008. Lower member 2028 of the glazing flange 2018 abuts exterior surface 2030 of the sash member 2008.

The present glazing flange 2018 is preferably assembled into a perimeter frame with welded corners. The corners of the polymeric glazing flange 2018 can be joined using thermal or ultrasonic welding, solvent bonding, adhesives and a variety of other techniques. The individual sash members 2008 are then assembled around the perimeter frame formed by the glazing flange 2018 to create the prime sashes 2002, 2004.

The present glazing flange 2018 provides a number of benefits over conventional wood glazing surfaces. Once the glazing flange 2018 is welded to form a perimeter frame, it serves as a structural member that increases the strength of the sashes 2002, 2004. Less wood is required for the sash members 2008. The interface between the glazing panel 2010 and the glazing flange 2018 is formed by materials that resist decay. The glazing flange 2018 also provides an excellent surface 2042 for engagement with cladding 2032.

Cladding 2032 is optionally attached to the glazing flange 2018 as illustrated in FIGS. 26 and 27. Perimeter seal 2034 is located along the interior surface 2036 of the prime glazing panels 2010. In the illustrated embodiment, the perimeter seal 2034 is releasably engaged with recess 2038 in the sash members 2008. An adhesive can optionally be located between the interior surface 2036 and the perimeter seal 2034. Seal 2040 on secondary sash 14 is preferably positioned to engage with a major surface of the perimeter seal 2034.

All patents, patent applications, documents and publications referenced in this document are incorporated by reference herein as if set out in their entirety. With regard to the foregoing description, it is to be understood that changes may be made in the details, without departing from the scope of the present invention. It is intended that the specification and depicted aspects be considered exemplary only, with a true scope and spirit of the invention being indicated by the broad meaning of the following claims.

What is claimed is:

1. A closure assembly comprising:

a frame;

a prime sash coupled to the frame;

a secondary sash hinged to at least one of the frame and the prime sash and movable between a closed position and an open position, the secondary sash having an edge;

a compressible member that biases the secondary sash toward the open position when the secondary sash is in the closed position; and a latch assembly comprising:

a plurality of retractable latching elements each biased toward an extended position to engage at least one of the secondary sash and the prime sash to retain the secondary sash in the closed position; and a sliding operator slideable along the edge of the secondary sash to sequentially displace each of the retractable latching elements one after the other to a retracted position to release the secondary sash sufficiently for the compressible member to move the secondary sash from the closed position toward the open position.

2. The closure assembly of claim 1 wherein the prime sash is coupled to the frame and movable between a closed position and an open position.

3. The closure assembly of claim 1 wherein the sliding operator is slidably coupled to the secondary sash.

4. The closure assembly of claim 1 wherein the sliding operator comprises a first tapered portion positioned to engage the retractable latching elements.

5. The closure assembly of claim 4 wherein the sliding operator moves along an axis and the first tapered portion comprises at least two discrete surfaces each of which is oriented at an acute angle relative to the first axis.

6. The closure assembly of claim 1 wherein the sliding operator comprises a first tapered portion positioned to engage with the retractable latching elements and a second tapered portion opposing the first tapered portion.

7. The closure assembly of claim 1 wherein the sliding operator moves along a first axis which is generally perpendicular to an axis of displacement of at least one of the retractable latching elements.

8. The closure assembly of claim 1 wherein the sliding operator is movable in either direction along an axis and is adapted to sequentially displace each of the retractable latching elements to the retracted position in either direction.

9. The closure assembly of claim 1 wherein each of the latching elements comprises a beveled surface and is displaced to the retracted position as the secondary sash is moved from the open position to the closed position.

10. The closure assembly of claim 1 wherein each of the latching elements comprises a pair of opposing arcuate surfaces positioned to engage the sliding operator and displace the latching element to the retracted position as the sliding operator is slid past the latching element.

11. The closure assembly of claim 1 wherein each of the latching elements comprises a pair of opposing angled planar surfaces positioned to engage the sliding operator and displace the latching element to the retracted position as the sliding operator is slid past the latching element.

12. The closure assembly of claim 1 wherein each of the latching elements comprises a notch positioned to engage the secondary sash and retain the secondary sash in the closed position.

13. The closure assembly of claim 12 wherein the notch forms an angle of greater than 90°.

14. The closure assembly of claim 1 wherein the compressible member comprises an elastomeric seal positioned between the secondary sash and the prime sash.

15. The closure assembly of claim 14 wherein the compressible member is positioned in a recess in the secondary sash and extends about the periphery of the secondary sash.

16. The closure assembly of claim 1 wherein the sliding operator is slidably coupled to the prime sash.

17. The closure assembly of claim 1 wherein the retractable latching elements are positioned on the prime sash.

* * * * *

UNITED STATES PATENT AND TRADEMARK OFFICE

CERTIFICATE OF CORRECTION

PATENT NO. : 7,765,741 B2
APPLICATION NO. : 11/297576
DATED : August 3, 2010
INVENTOR(S) : Gary L. Miller et al.

It is certified that error appears in the above-identified patent and that said Letters Patent is hereby corrected as shown below:

Column 15

Line 26, claim 5
Delete the word "first"

Signed and Sealed this
Twenty-first Day of February, 2012

David J. Kappos

David J. Kappos
*Director of the United States Patent and Trademark Office*